US007153251B2

(12) United States Patent
Broadbent

(10) Patent No.: US 7,153,251 B2
(45) Date of Patent: Dec. 26, 2006

(54) STRETCHING APPARATUS

(76) Inventor: Hugo Broadbent, 41 Fanshaw Road, Eckington, South Yorkshire, Sheffield (GB) S21 4BW ( * ) Notice: Subject to any disclaimer, the term of this patent is extended or adjusted under 35 U.S.C. 154(b) by 0 days.

(21) Appl. No.: 10/518,319

(22) PCT Filed: May 14, 2003

(86) PCT No.: PCT/GB03/02066

§ 371 (c)(1),
(2), (4) Date: Dec. 14, 2004

(87) PCT Pub. No.: WO03/105745

PCT Pub. Date: Dec. 24, 2003

(65) Prior Publication Data

US 2005/0227837 A1 Oct. 13, 2005

(30) Foreign Application Priority Data

Jun. 14, 2002 (GB) ..... 0213693.5

(51) Int. Cl.
*A63B 71/00* (2006.01)

(52) U.S. Cl. ..... 482/148

(58) Field of Classification Search ..... 482/142, 482/148, 23, 51, 907
See application file for complete search history.

(56) References Cited

U.S. PATENT DOCUMENTS 4,647,040 A 3/1987 Ehrenfried
5,374,230 A 12/1994 Bonnaime et al.

FOREIGN PATENT DOCUMENTS

| | | |
|---|---|---|
| FR | 2 357 236 | 7/1976 |
| WO | WO 94/28978 | 12/1994 |
| WO | WO 03/004105 A2 | 1/2003 |

OTHER PUBLICATIONS

Combined Search and Examination Report for Application GB 0213693.5 from United Kingdom Patent Office dated Dec. 16, 2002.
Examination Report for Application No. GB 0213693.5 from United Kingdom Patent Office dated Feb. 20, 2004.
Examination Report for Application No. GB 0213693.5 from United Kingdom Patent Office dated Jun. 3, 2004.
Examination Report for Application No. GB 0213693.5 from United Kingdom Patent Office dated Aug. 20, 2004.
International Search Report for PCT/GB03/02066 mailed Sep. 2, 2003.

*Primary Examiner*—Lori Amerson
(74) *Attorney, Agent, or Firm*—Harness, Dickey & Pierce, P.L.C.

(57) ABSTRACT

Stretching apparatus for use in stretching the lower limbs of a human subject is disclosed. The apparatus (500) comprises at least one cradle configured to support a leg, or part thereof, of said subject, said cradle moveable between a non-stretching position and a stretching position. At least one cradle movement means (504) is provided operable to move said cradle between said non-stretching and stretching positions. The cradle movement means (504) comprises first movement means configured to move said cradle through a first plane of movement and second movement means configured to rotate said cradle through a second plane of movement transverse to said first plane of movement.

50 Claims, 19 Drawing Sheets

A

B

STRETCHING APPARATUS

FIELD OF THE INVENTION

The present invention relates to an apparatus for stretching muscles, tendons, ligaments and other soft tissues of the human body and particularly although not exclusively for stretching muscles of the hip joint and lower limbs.

BACKGROUND TO THE INVENTION

Human limb flexibility, including muscle extensibility and joint mobility is known to be of importance in the prior art in sport and general fitness for the avoidance of injury and improvement of performance as well as in clinical rehabilitation following injury.

The hip joint is of considerable importance regarding athletic activity. Abnormal function of the hip pre-disposes the subject to a variety of sports injuries. In the non-athletic population hip dysfunction may ultimately lead to arthritis and back pain. Stretching exercises are known to be used to improve hip mobility to reduce predisposition to injury or disorder. Hip stretching exercises are difficult to perform unaided, that is in the absence of a physiotherapist, due to the need to stabilize the pelvis, thus isolating the hip joint to ensure that movement takes place only at/around the hip joint whilst conducting the exercises and also due to the considerable forces required to overcome tightness in strong muscles and other soft tissues of the hip joint in performing the stretches.

A small number of prior art stretching apparatus are known including U.S. Pat. Nos. 4,574,789, 5,405,306, 4,647,040, FR 2613238, U.S. Pat. Nos. 5,449,336, 5,261,865, 4,819,936 and FR 2,357,236.

U.S. Pat. Nos. 5,405,306, 5,449,336 and 5,261,865 all disclose stretching apparatus for stretching of human lower limbs. Each apparatus consists of a frame provided to allow a subject to be positioned in a supine position, that is on their back. A material loop or cuff is provided for positioning over the foot or ankle of the subject wherein the cuff is connected to a cable. The cable is arranged over a system of pulleys to extend to a handle connected to one end of the cable. By pulling on the handle the subject can raise and lower one or both legs to perform a stretch. In U.S. Pat. No. 5,405,306 the cable can be arranged through one of a plurality of pulley sets to enable both flexion and abduction stretches of the lower limbs. In U.S. Pat. Nos. 5,449,336 and 5,261,865 a belt is provided to encircle the subject's waist in order to stabilize the pelvis against the base platform of the apparatus.

Prior art apparatus of a type such as that disclosed in U.S. Pat. No. 5,405,306 requires substantial variation of the setup configuration to perform more than one type of stretch. Limited abduction and adduction of the hip joint can be performed by pulling of cables to transfer a component of force to the coronal plane. This system is energy inefficient and introduces unwanted force components which act to stretch the limb in other planes of movement and which result in undesirable strain of the stretching muscles. The result is a mixing of stretches which limits the ability to controllably perform a desired stretch.

FR 2613238 and U.S. Pat. No. 4,647,040 provide stretching apparatus arranged for abduction of the lower limbs. Leg supports are provided upon which the subject rests their legs. An actuating arm enables the subject to perform abduction stretches.

U.S. Pat. No. 5,913,759 discloses apparatus for performing extension stretching of the thigh muscles wherein an arm member contacts the front muscles of the users thigh and a motor is provided to urge the arm contacting the thigh downwardly thus stretching the thigh muscles on the front side of the leg.

FR 2357236 discloses apparatus for performing kinetic joint therapy wherein a moving panel hinges on a horizontal fixed panel. The moving panel provides a leg support and the fixed panel may be used to secure the upper body in position. This apparatus relies on the leg muscles of a subject or a second person to position the moving panels; it has no actuating means by which the subject can effect movement. Furthermore, it does not allow adduction or rotation stretches to be performed.

Prior art stretching apparatus provides for specific lower limb stretching exercises to be performed. The use of cable and pulley systems is disadvantageous for several reasons. Use of cable and pulley systems does not enable precise movement of the limb during stretch as the cable is flexible to pivot about the pulleys such that the limb being stretched cannot be maintained within a single desired plane of stretch. Further, where the subject is required to manually operate the application of tension to the cables by pulling on the cable ends the tension applied to the stretch cannot be maintained uniform. This also results in the fatigue of the subject through application of tension to the cables which results in inability to maintain the limb in the stretched position.

When considering hip stretching exercises no single prior art apparatus provides for controlled stretching of the hip joint in all six anatomical directions. Where cable systems are used the prior art apparatus are required to be adjusted by repositioning or reattachment of the cable pulley system between different stretches. Use of straps or cuffs attached to the ankles results in uncontrolled stretching and use of the cable system has a result that the lower limb being stretched is subject to undesirable compressive or tensile forces along its length.

In order to perform controlled stretching of single lower limbs it is necessary to position the resting lower limb in a substantially fixed resting position. The prior art apparatus does not provide means for positioning the resting limb in a predetermined resting position which assists stretching of the stretching limb.

It is also known in the prior art that during flexion stretching the thigh of the resting leg will tend to rise as the stretching leg reaches maximum tension. This is unwanted as the subject's pelvis is tilted backwards as a result which reduces the effectiveness of the stretch.

Isokinetic testing apparatus, such as the Multi-Joint System 3 apparatus manufactured by Biodex Medical Systems Inc. New York, USA are also known in the prior art. Such isokinetic testing apparatus provide means for measuring muscle strength by application of a resistive force to a limb against which the subject pushes. These machines are known in the prior art for use in monitoring muscle strength and are useful in monitoring a subject's recovery from injury. In the prior art, apparatus for improving and/or monitoring muscle strength do not provide for stretching of the same muscles in a controlled manner.

SUMMARY OF THE INVENTION

Specific embodiments according to the invention provide an apparatus for movement of the human lower limbs passively in specified pre-determined anatomical directions in order to increase or maintain a range of motion (ROM) of the hip joint is provided. A stretching force is applied in a controlled manner to stretch soft tissue structures, particularly the muscles that cross, or extend to/from the hip joint. Controlled positioning and stabilisation of the lower limbs allows the subject to perform appropriate stretching regimes either unassisted or as directed by a therapist.

The stretching apparatus comprises two limb cradles, each arranged to fit independently movable and each arranged to fit under a subject's leg to support the leg. Preferably, each cradle connects to a cradle movement means having two pivots each defining an axis of rotation and providing for movement of the cradle through two planes of movement transverse to each other, and preferably orthogonal. Preferably a handle is provided for manual operation, but optionally movement of each cradle may be powered by an electric motor or may be servo assisted.

By providing two cradles which can be moved independently and which are configured to move in either the same plane or a different plane to each other, the position of both the resting leg and stretching leg can be carefully controlled. It is advantageous to fix the resting leg and pelvis of the subject during stretch of the stretching leg as this allows for quantitative comparisons of the relative degree and extent of stretch between the two legs.

According to one aspect of the invention, there is provided a stretching apparatus for use in stretching the lower limbs of a human subject said apparatus comprising:

first and second cradles each independently movable and each configured to support a leg, or part thereof, of said subject, each said cradle being movable between a corresponding respective non-stretching position and a corresponding respective stretching position; and at least one cradle movement means operable independently to move each said cradle between said non stretching and stretching positions, said at least one cradle movement means comprising:

first movement means configured to rotate each said cradle in a corresponding respective first plane of movement; and second movement means configured to rotate each said cradle in a corresponding respective second plane of movement transverse to a said first plane of movement.

Other aspects of the invention are as recited in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

In this specification the term cradle relates to a support, cuff, collar, stirrup or other support means configured to support a human subject's leg, or part thereof, in a selected position.

Figure 1:
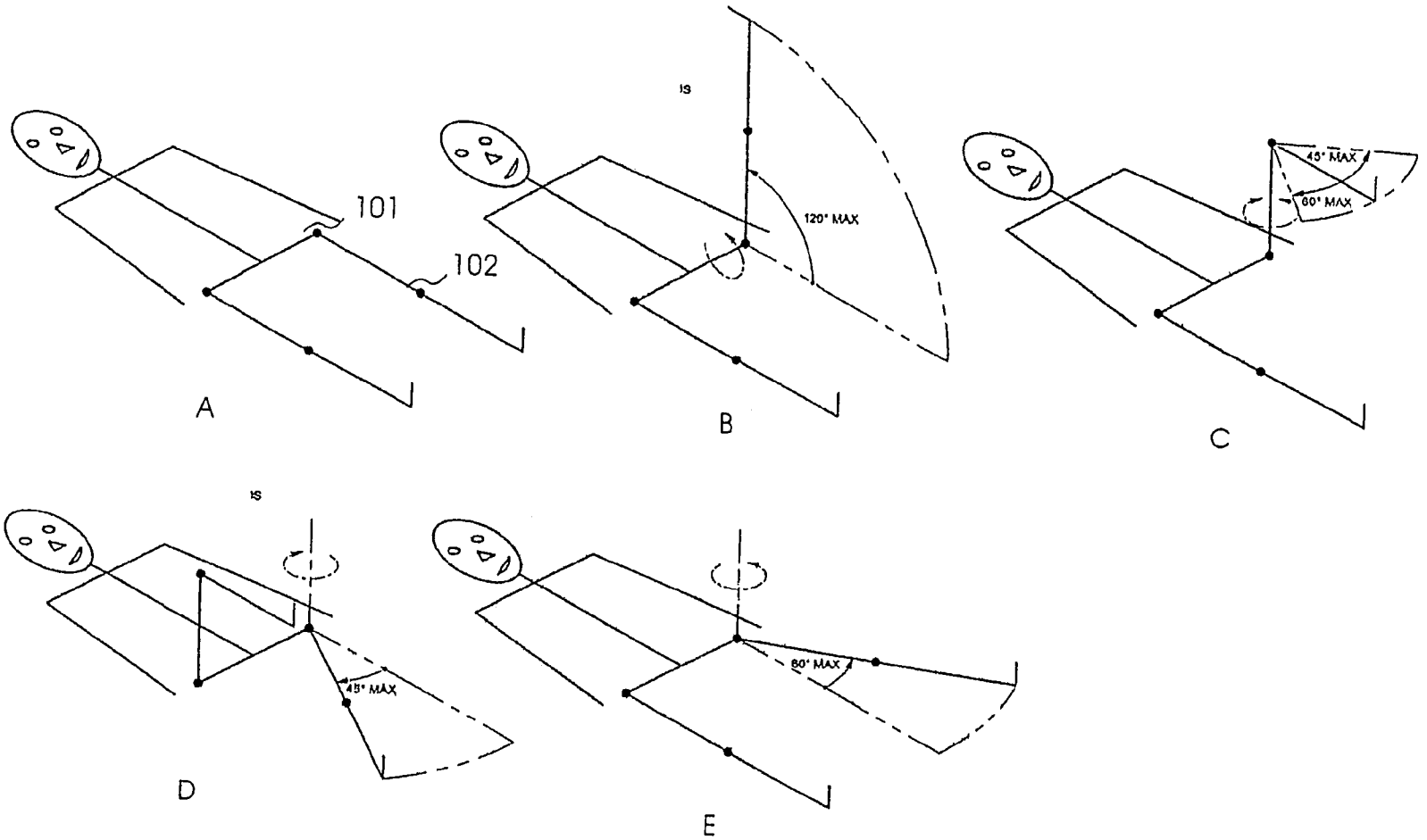
FIG. 1A to E illustrates diagrammatically flexion, medial and lateral rotation, adduction and abduction stretching of a subject's leg and the associated rotational movement of the hip joint.

Referring to FIG. 1 herein, FIG. 1A illustrates diagrammatically a human subject in the supine position and illustrating a representation of the subject's hip joint 101 and knee joint 102 of each lower limb. FIGS. 1B to E illustrate the stretches which can be performed by using the stretching apparatus of the present invention.

FIG. 1B illustrates flexion of the subject's left leg wherein the subject's leg is raised by movement of the leg about the hip joint in the sagittal plane of motion. In performing this stretch the stretching leg is lifted upwards from the resting position to a maximum displacement of approximately 120° from the resting supine position wherein the limb is in-line with the main length of the subject's body. Flexion stretches the hamstrings at the back of the subject's thigh and in particular the Semimembranosus, Semitendinosus, Biceps femoris muscles as well as partially stretching the Gluteus maximus.

FIG. 1C illustrates the subject's left leg raised from the resting position such that the knee is bent at approximately 90° to the thigh which is maintained transverse and generally orthogonal to the subject's main body length. With the leg in this position where the hip and knee are both bent at approximately 90° planar movement of the leg between the knee and foot enables rotational stretching of the hip joint. In particular, planar movement away from the subject's body is known as medial rotation resulting in stretching of the lateral rotator muscles, in particular of the Piriformis, Gemellus superior, Gemellus inferior, Obturator internus, Obturator externus, Quadratus femoris. Planar movement of the foot or calf towards and across the midline of the subject's body is known as lateral rotation resulting in stretching of the medial rotator muscles, in particular the Gluteus medius, Gluteus minimus and Tensor fasciae latae.

FIG. 1D diagrammatically illustrates adduction stretching wherein the subject's left limb is maintained outstretched in the supine position and the leg is moved through the coronal plane (also known as the frontal plane) about the hip joint to move the leg towards and across the midline of the subject's body so as to stretch the thigh abductors, in particular the Gluteus medius, Gluteus minimus, Tensor fasciae latae and the soft tissue structure of the Iliotibial band. During adduction stretching the resting limb is preferably placed in a rest position which avoids obstruction of the adduction stretch of the stretching limb. In FIG. 1D the rest position is illustrated with the leg raised and bent.

FIG. 1E illustrates abduction stretching wherein the subject's left leg is moved about the hip joint by rotation through the coronal plane of movement, the outstretched straight limb being moved away from the body to stretch the thigh adductors, in particular the Adductor brevis, Adductor longus, Adductor magnus, Gracilis and Pectineus muscles.

Figure 2:
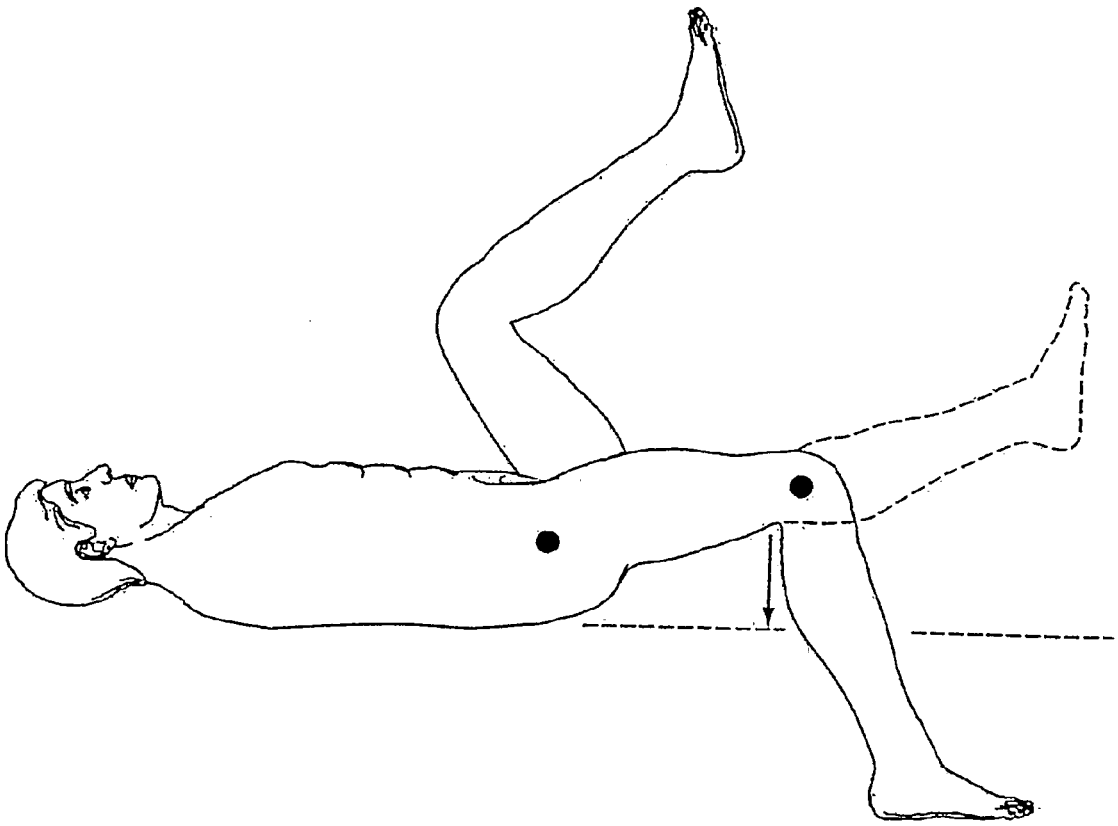
FIG. 2 illustrates diagrammatically extension stretch of a leg about the hip joint.

Referring to FIG. 2 herein, a subject is illustrated in position for performing extension stretching. The subjects left resting (contralateral) leg is held in a leg support cradle in a raised and bent resting position of approximately 120° hip flexion and 90° knee flexion which has the effect of tilting the subjects pelvis posteriorly. For a subject whose extension stretching is less than optimal the stretching thigh (right thigh in FIG. 2) will rise above the horizontal. The stretching leg is retained in the support cradle by straps and the cradle is released to move under gravity towards the horizontal position. This enables extension stretching to be performed wherein the stretching leg moves through a first plane of movement around the hip joint to stretch the subjects hip flexors at the front of the subject's thigh, in particular the Psoas major, Iliacus, Sartorius, Tensor fasciae latae. The stretching leg is maintained and supported by the cradle at either 90° knee flexion, which stretches the Rectus femoris in addition to the hip flexors, or 0° knee flexion (the dashed outline of the subject's lower leg) which stretches the Iliotibial band in addition to the hip flexors.

The stretches illustrated in FIGS. 1 and 2 and described above enable selective stretching of the hip joint through all six anatomical directions, i.e. flexion and extension, abduction and adduction and medial and lateral rotation. The stretching apparatus of the present invention enables the subject to perform each of these stretches in an independent and mutually exclusive manner which enables the user to carefully control the extent of stretch and to monitor relative progress of the subject.

Figure 3:
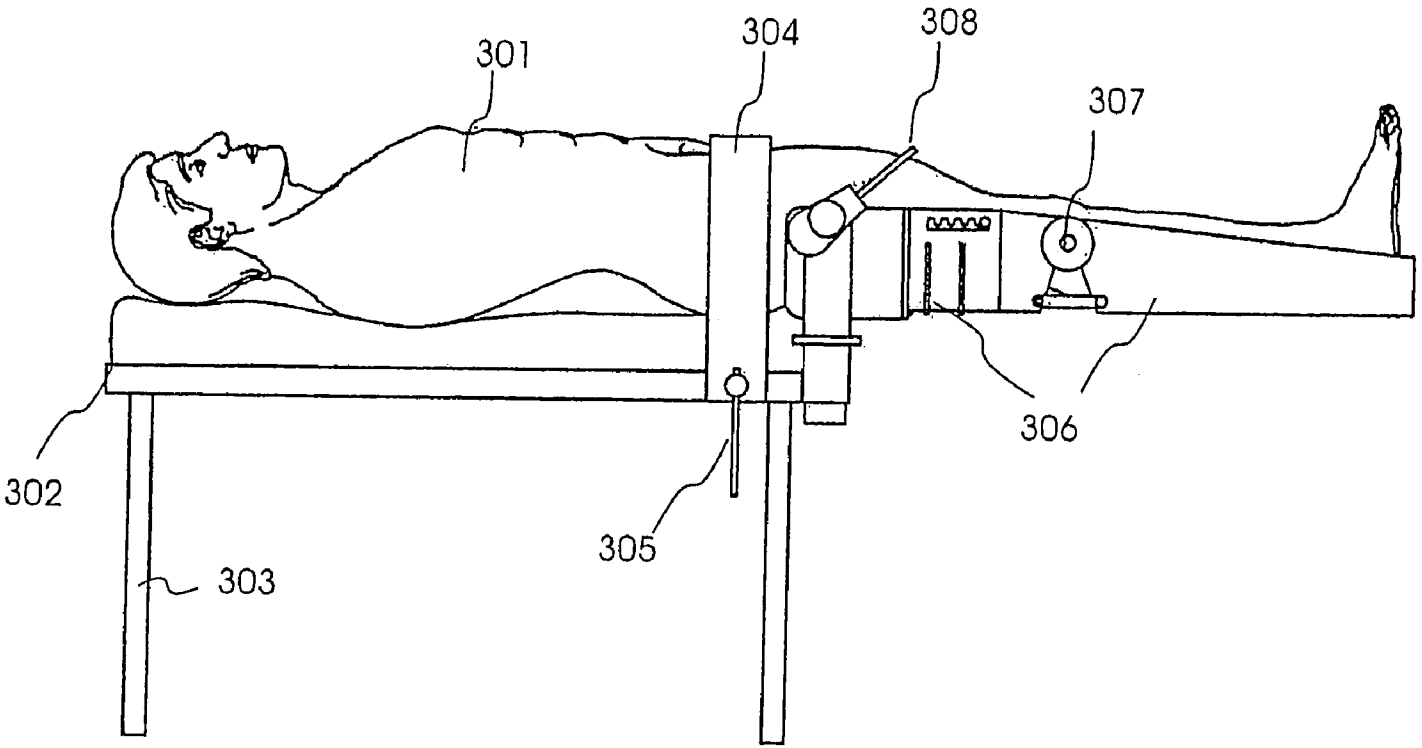
FIG. 3 illustrates in-use positioning of a subject on the stretching apparatus of the present invention.

FIG. 3 illustrates apparatus according to a first embodiment of the present invention in use by a subject. The subject 301 is illustrated in resting supine position. The subject's head and upper body as far as the hips is supported on an examination table 302 typically comprising a padded couch to support the subject's back. The examination table is raised from a ground surface by one or a plurality of leg supports 303 which raise the examination table approximately 60–80 cm from the ground surface. The leg supports 303 are optionally adjustable to accommodate subject's of varying size. Two cradles 306, each configured to support one of the subject's legs extend from one end of the examination table. In supine position the subjects upper body and head are supported by the padded couch 302 and the subject's legs are located in cradles 306 and, in resting position, each cradle 306 extends in-line with the examination table so that the user is in a relaxed supine resting position. A pelvic clamp 305 forming a vice-like restraint to stabilize the pelvis laterally by gripping the subject's ilium on either side is provided. The clamp 305 is attached to the examination table in the region of the end of the examination table adjacent cradles 306. The pelvic clamp comprises two clamping members arranged on opposite sides of the examination table and connected by a screw member. Rotation of a handle at one end of the connecting screw member urges the clamping members 304 together to grip the subject at the pelvis. Once clamped, the subject's pelvis is prevented from tilting laterally during stretching such that the hip joints and lower limb joints and muscles are effectively isolated from the upper body movements during stretching. Optionally, a belt may be further provided to locate over the subject's waist to further facilitate isolation of the hip joint from the upper body during stretching. A cradle movement means is provided at the connection between cradles 306 and table 302 such that an axis of the cradle movement means is in line with the main axis extending through the subject's hip joints. The cradle movement means comprise a handle on the exterior facing side of the apparatus which is within reach of the users arms (not shown) when in supine position such that the subject can control movement of the cradles 306 to perform the required stretching exercises.

Figure 4:
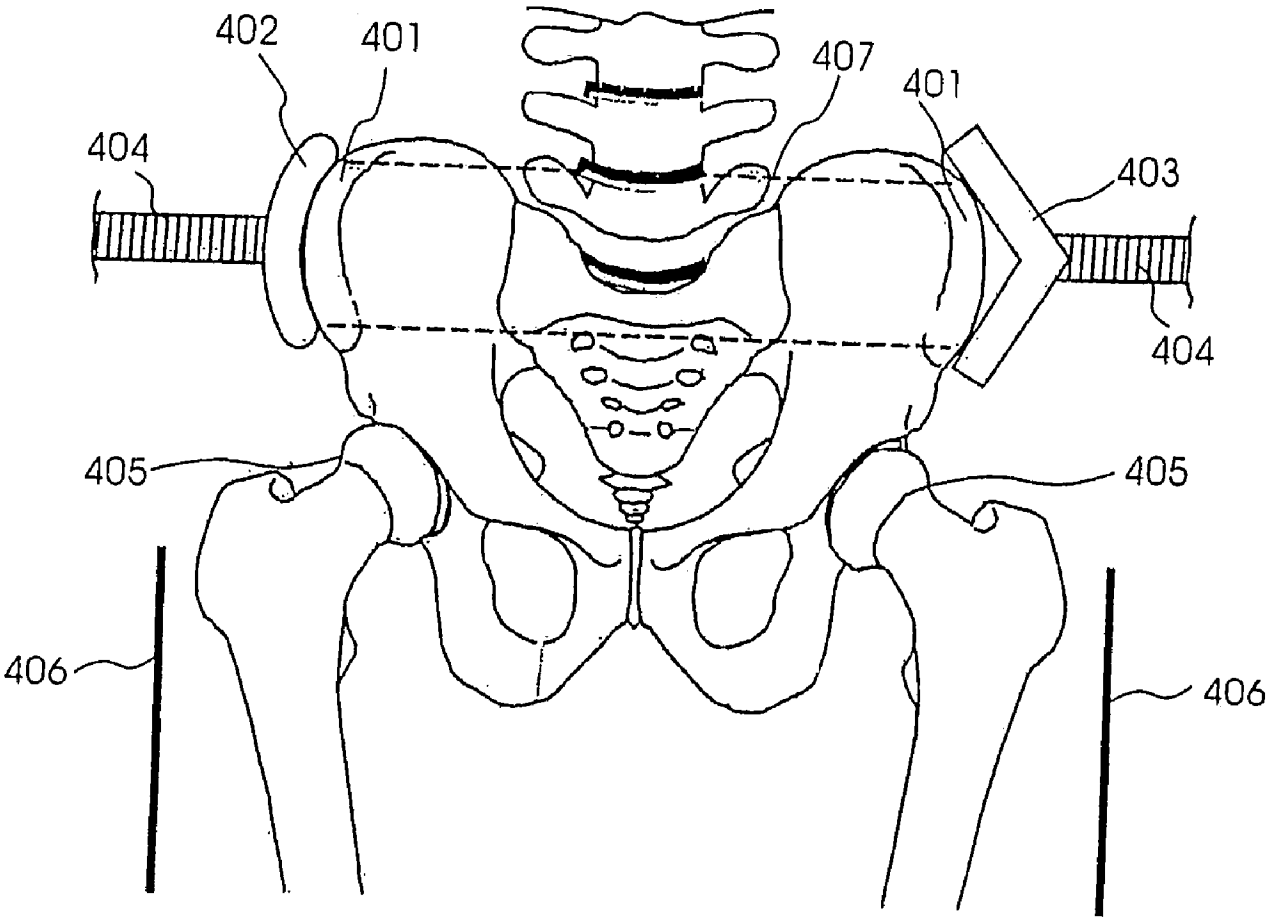
FIG. 4 illustrates diagrammatically the location of a pelvic clamp at the pelvis of the subject during use of the stretching apparatus of the present invention to prevent lateral tilting of the pelvis and to isolate the hip joint for performing stretching exercises.

Referring to FIG. 4 herein an outline of the bone structure of the subject's pelvis and hip joint when positioned on the apparatus of the present invention in accordance with FIG. 3 is illustrated. Clamping members 402, 403 having a shape and configuration designed to engage at and grip the iliac crests 401 of the subject's pelvis are provided. FIG. 4 illustrates two designs of clamping member, a first design 402 having a C-shaped cross-section and a second design 403 having a V-shaped cross-section. A screw member 404 is provided with an actuating arm to urge the clamping members 402, 403 together to grip the iliac crests of the subject's pelvis in a vice-like manner. Each clamping member 402, 403 is approximately 10 cm in width, sufficient to encapsulate the profile of the subject's iliac crests. A belt 407 is optionally further drawn across the subject's waist to further prevent rotation of the pelvis during stretching. The subject's hip joints 405 are thus isolated from the upper body during stretching. The outer edge of the cradles 406 are illustrated adjacent the hip joints.

The pelvic clamp 305 is optionally configured to tilt forwards and backwards through predetermined positions allowing the subject's pelvis to be positioned at a desired degree of tilt during stretching. The clamping members are optionally configured for automatic adjustment to grip the subject's pelvis. Pressure sensing means are optionally provided to sense contact of the clamping members 402, 403 with the subject's pelvis. The sensing means feedback control signals to a processor which operates to automatically move the clamping members 402, 403 to maintain a selected clamp pressure at the pelvis.

Figure 5:
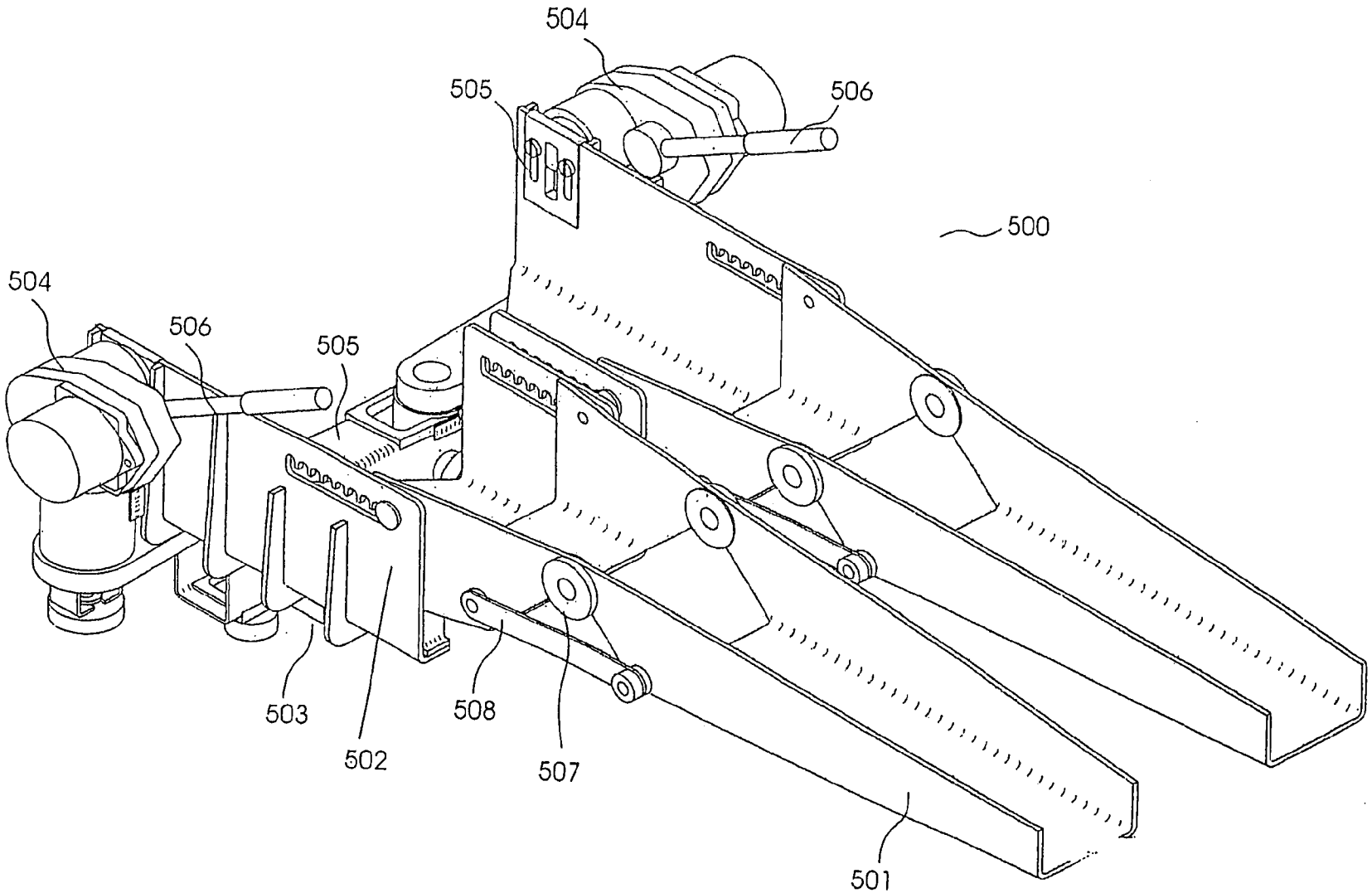
FIG. 5 illustrates a first embodiment of the stretching apparatus of the present invention in external perspective view.

FIG. 5 illustrates an external perspective view of a first embodiment of the stretching apparatus of the present invention. Two cradles are illustrated for supporting the subject's lower limbs, particularly the subject legs and feet. Each cradle is made up of three sections. A first section 501 is provided to support the subject's calf, ankle and foot, a second section 502 is provided to support the subject's lower thigh and a third section 503 supports the subject's upper thigh and buttocks. Each cradle is formed in the shape of a channel profiled to correspond to the general profile of the human leg. Mirror image channels are provided on corresponding cradles formed on either side of the apparatus to correspond to the right and left leg profiles. First and second cradle sections 501, 502 are connected by a hinge 507 permitting movement of the first cradle section 501 about the hinge to accommodate bent-knee leg positions. A connecting bar and hinge 508 forms a locking means enabling each cradle to be locked in a substantially linear or angled position. Third cradle section 503 is mechanically fastened to the cradle movement means 504. Two cradle movement means 504 are provided, each providing separate means to independently operate movement of the attached cradle. A frame 505 connects the two cradle movement means 504 and locates each cradle movement means in opposing orientation at one end of the respective third cradle section 503. Each cradle movement means 504 further comprises a handle portion 506 arranged such that the subject occupying the stretching apparatus can grasp each handle portion 506 with their respective hand to operate movement of the cradles to perform a stretch. Each cradle movement means 504 is mounted on a respective third cradle section 503 by means of a plate and fastening means e.g. screw or bolt fastening means 505. The plate fastening cradle movement means 504 to third cradle section 503 comprises slots enabling the height of the cradle movement means 504 to be adjusted such that an axis through the subject's hips is in-line with the axis of rotation of the cradle movement means 504 through a first plane of movement.

Figure 6:
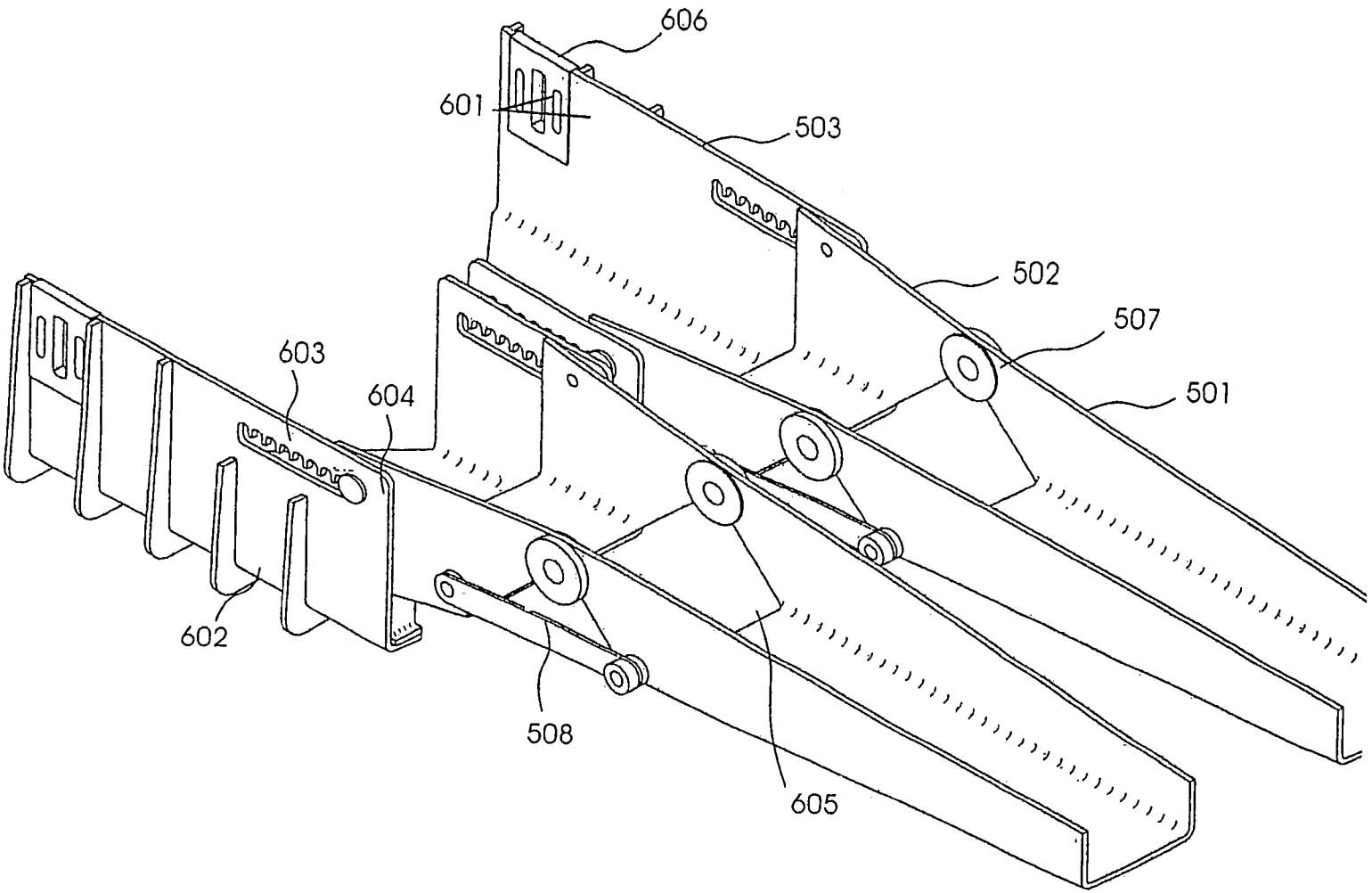
FIG. 6 illustrates in external perspective view the limb cradles and chassis of the stretching apparatus in accordance with a first embodiment of the present invention.

FIG. 6 illustrates an external perspective view of the two cradles of the stretching apparatus in the absence of the cradle movement means and connecting frame. Each cradle formed by first, second and third cradle sections 501, 502, 503 forms a limb support and is made of either molded plastics material or preformed metal sheet lined with padded material so as to provide a comfortable leg support. First cradle section 501 configured to support the lower leg is connected to second cradle section 502 at hinge 507 which allow for rotation of the first cradle section about hinge 507 such that non-linear leg positions can be accommodated and supported by each cradle. First and second cradle sections 501, 502 are further connected by a locking means 508 in the form of a guide bar extending between the side portions of the two cradle sections. Guide bar 508 is configured to releasably lock first and second cradle sections 501, 502 in linear position. Unlocking the locking means 508 provides for relative movement of the first and second cradle sections 501, 502 so that the subject may position one or both legs in a bent arrangement. The locking means can be reengaged once in bent configuration so as to support one or both legs in the bent position. First and second cradle sections 501, 502 are formed such that, in the linear arrangement illustrated in FIG. 6, a gap 605 is provided between the base portion supporting the subject's legs, this gap 605 providing for relative transverse movement of the first and second cradle section 501, 502.

Further referring to FIG. 6 herein, each second cradle section 502 is adjustably mounted at the third cradle section 503. Each third cradle section 503 comprises a base portion and walls defining a channel, each wall portion comprising an aperture having a plurality of slotted recesses. A fastening hinge member 604 extends through aperture 603 and a wall portion of the second cradle section 502 to securely connect second and third cradle sections 502, 503. Fastening hinge means 604 is moveable through aperture 603 to engage at a selected slotted recess thereby providing an adjustment mechanism. Adjustment of the position of the second cradle section 502 at the third cradle section 503 provides a length adjustment mechanism for the stretching apparatus to accommodate a variation in subject lower limb size which enables the hip joint to be located adjacent to the cradle movement means of the apparatus and the knee joint to be located adjacent to hinge 507. Plate member 606 having slots 601 is provided on the external wall portions of the third cradle section 503 for attachment to the cradle movement means. Each third cradle section 503 has a ribbed external structure 602 providing support and strength to the stretching apparatus.

Figure 7:
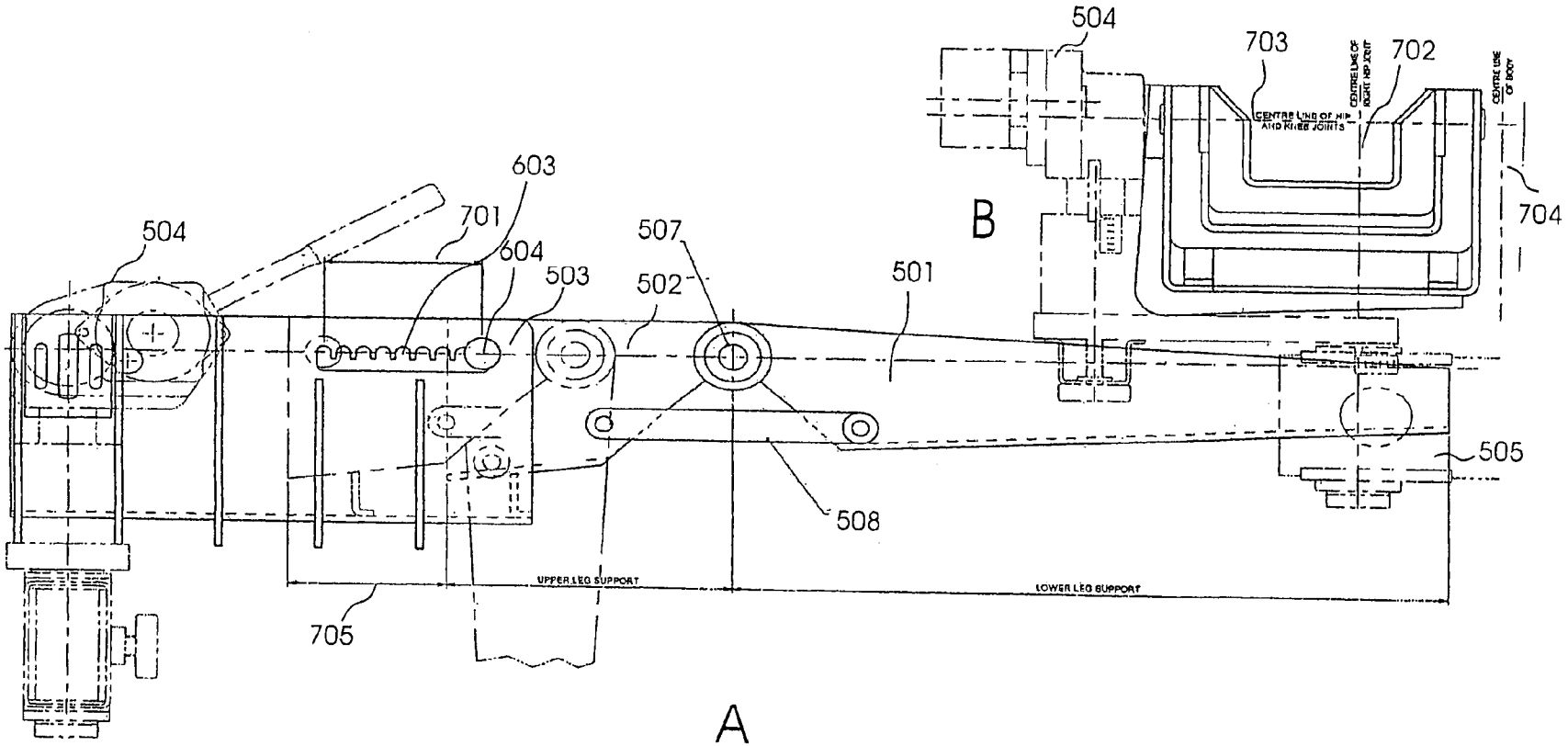
FIG. 7A illustrates a side view of the right hand limb cradle and chassis of the stretching apparatus in accordance with the first embodiment of the present invention and illustrating the positioning of the cradle movement means.
FIG. 7B illustrates an end view of the right hand limb cradle in accordance with the first embodiment of the stretching apparatus of the present invention.

Referring to FIG. 7A herein there is illustrated an engineering drawing showing a side view of the right hand limb cradle. The lower leg support 501 is illustrated to be connected to the upper leg support 502 by a pivot 507 corresponding to the position of the subject's knee joint during use. Locking means 508 is formed by a latch plate which allows the upper and lower leg supports 502, 501 to be fixed in-line or at right angles, although any suitable locking means such as a spring loaded plunger may be used. Aperture 603 in the third cradle section provides 110 mm length of adjustment for variations in the subject's upper leg length, illustrated by arrow 701. The variable position of the upper leg support 502 through adjustment of the fastener 604 through the slotted aperture 603 is illustrated by arrow 705 and the dashed outline of the upper leg support 502 in the adjusted position. The position of the cradle movement means 504 is superimposed on the third cradle section 503.

FIG. 7B illustrates an end view of the right hand limb cradle of the stretching apparatus with the control movement means 504 and frame 505 superimposed and illustrated by dashed lines. The position of the centre line of the hip and knee joints of the subject during use are illustrated by dashed line 703 and the position of the centre line of the right hip joint of the subject during use is illustrated by dashed line 702. The position of the centre line of the subject's body during use of the stretching apparatus is illustrated by dashed line 704.

Figure 8:
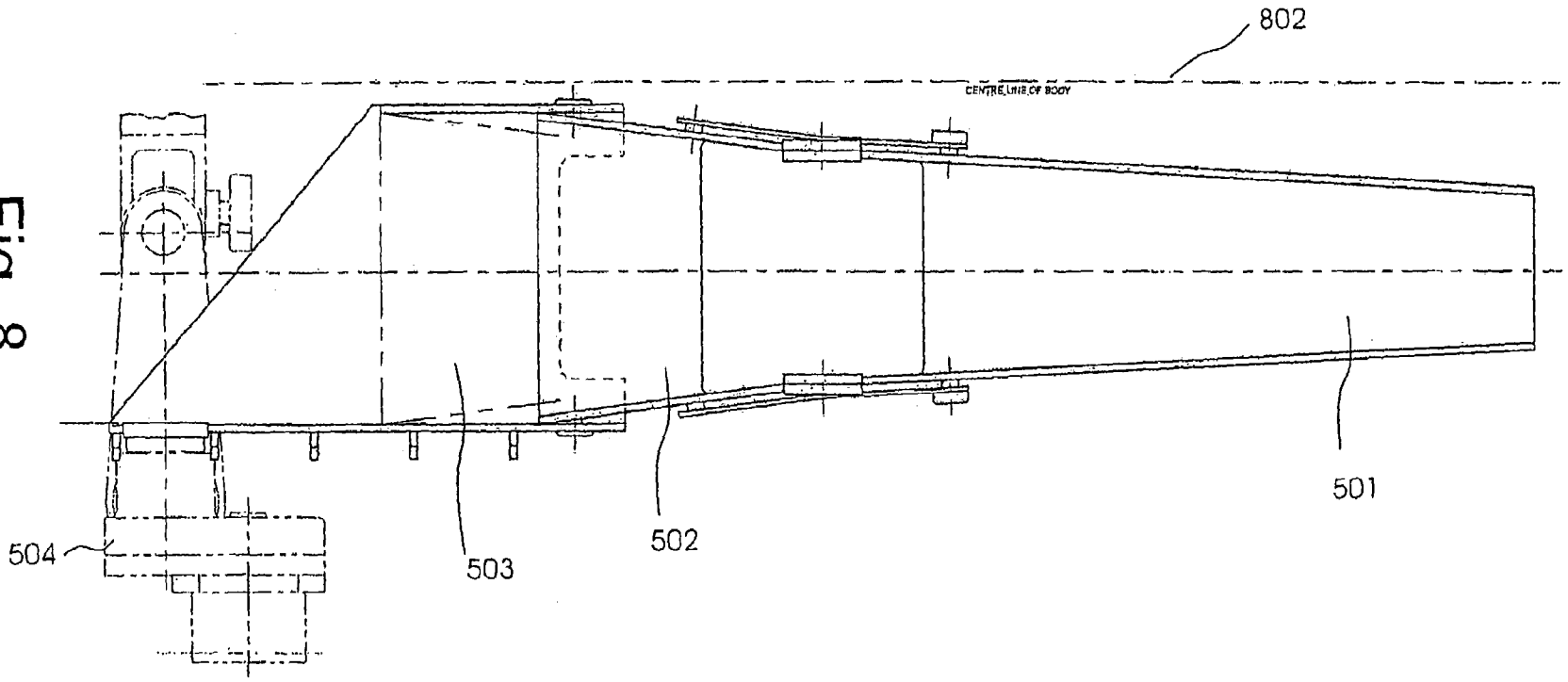
FIG. 8 illustrates a plan view of a right hand limb cradle in accordance with the first embodiment of the stretching apparatus and further illustrating positioning of the right hand cradle movement means.

FIG. 8 illustrates a plan view of the right hand limb cradle of the stretching apparatus. Each cradle section 501, 502, 503 comprises a base portion and wall portions forming a channel and is manufactured from pressed aluminum powder coated and lined internally with a padded material. The subject's leg is retained in the limb cradle through the use of straps attached to the first and second cradle sections 501, 502. These straps (not shown) may comprise buckled straps or Velcro® straps extending from opposite wall portions of the cradle section and over a leg housed therein. The centre line of the subject's body 802 is illustrated. Further, the right hand side cradle movement means 504 is superimposed and illustrated by way of dashed lines.

Figure 9:
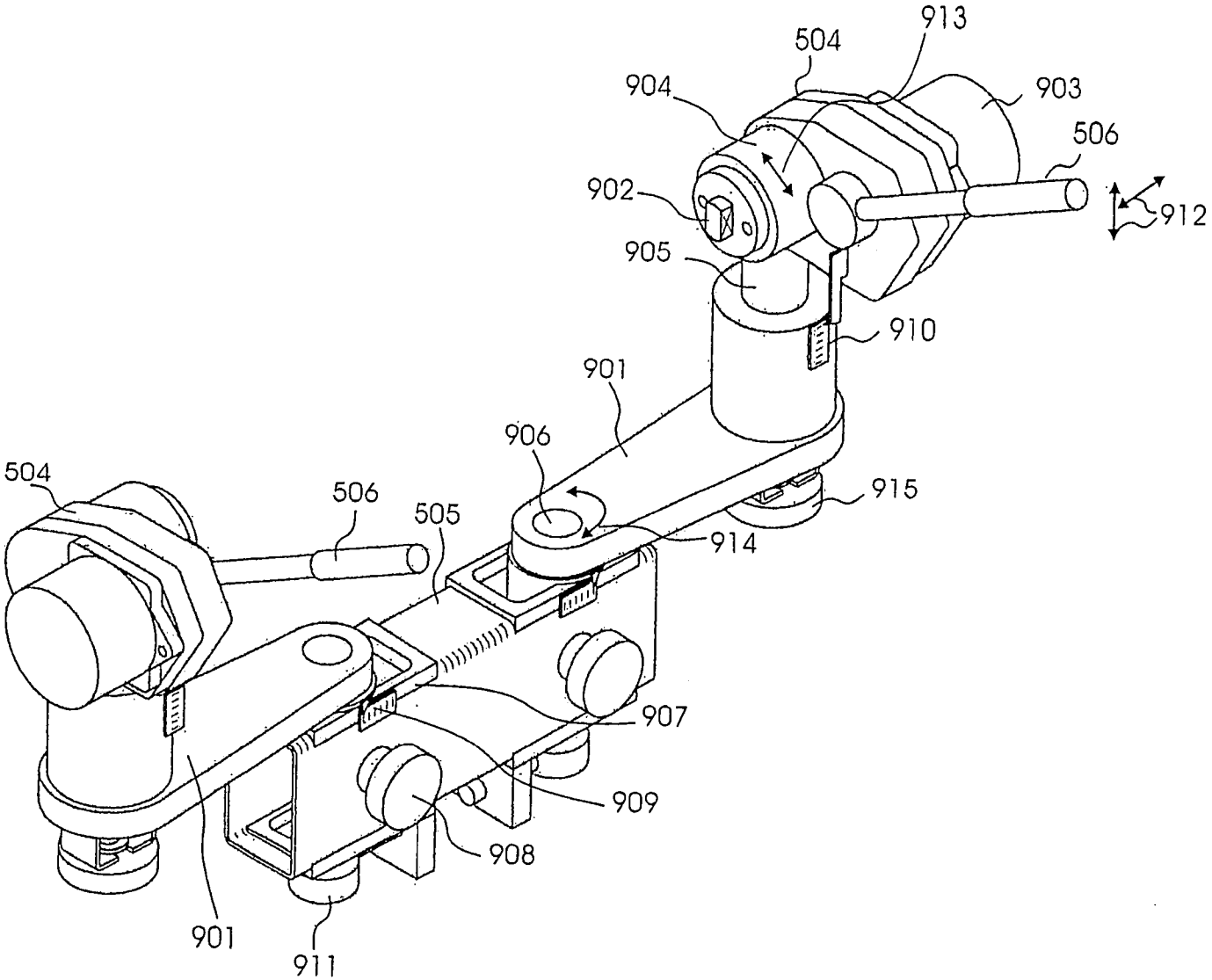
FIG. 9 illustrates in external perspective view the limb cradle movement means.

FIG. 9 illustrates an external perspective view of the right and left hand side cradle movement means and connecting frame 505. Each cradle movement means comprises a base plate 901 arranged to form an arm for transfer of rotational movement about bearing 906. Each limb cradle is fastened through plate member 606 to a cradle movement means. An axle member 902 projects through plate 606 to operate raising and lowering of the cradle. Movement of axle member 902 is thus communicated directly to the respective cradle. Each cradle movement means 504 further comprises a handle 506 and first bearing 904. Handle 506 is moveable through a first vertical plane of movement and second transverse plane of movement indicated by arrows 912. The handle 506 is optionally specifically shaped, e.g. L-shaped, to enable ease of use in movement through the two planes of movement. In use, the subject manually pulls handle portion 506 or pushes handle portion 506 to move the handle portion through a first plane of movement. This causes movement of bearing 904 in one of the directions indicated by arrow 913. This movement is transferred to axle member 902 as a rotation of the axle member which is then transferred to the connected limb cradle to raise or lower the entire limb cradle accordingly. Cradle movement means 504 comprises a locking ratchet mechanism (not shown) which is coordinated with handle 506 such that a raised or lowered limb cradle position can be maintained in locked position by activating the locking ratchet. The ratchet may further co-operate with a damping mechanism 903 such that on release of the ratchet lock the respective cradle is lowered under control of the damping mechanism 903 such that the limb housed in the cradle is lowered slowly. Alternatively, a switch (not shown) may be provided to reverse the direction of movement that the locking ratchet mechanism controls, such that by pushing the handle portion 506 the subject can exert a substantially downward force for extension stretches.

Further referring to FIG. 9 herein, when the handle portion 506 is moved in a plane transverse to the first plane of movement, i.e. in the left or right direction, the supporting plate and cradle movement means and attached cradle is moved about a second bearing member 906. This causes rotation according to arrow 914 about the axis of second bearing member 906 with the result that the attached cradle is moved in a direction either across the midline of the subject's body or away from the midline of the subject's body. Handle portion 506 and first bearing member 904 are mounted on a support column 905 connecting with the base plate 901 and second bearing set 906. A scale 910 is provided on the support column to indicate the height adjustment of the control movement means from the base plate 901. Control knob 915 located on the underside of the base plate and in-line with column 905 provides, through a rotation of knob 915, for adjustment of the height of the cradle movement means 904. Before commencing use of the apparatus for stretching the subject is directed to adjust the height of each cradle movement means such that the axle member 902 is substantially in line with the main axis through the subject's hip joints. This is desired for optimal stretching performance.

Further referring to FIG. 9 herein, frame member 505 forms a housing to support both cradle movement means. Each cradle movement means is located in a slotted aperture formed in the frame member 505. A supporting column extends through aperture 505 and is locked in position by a control knob 508 rotatable to fix the supporting column in position. A ratchet mechanism 911 is further provided at the base of each support column extending through frame member 505 to control the rotational movement of the cradle movement means about second bearing set 906 and to enable the apparatus to be maintained in the stretching position until released by the subject wherein the return path of the bearing is optionally damped to prevent sudden movement upon release of the stretch. Through use of control knobs 908 the width of the control movement means is adjusted and monitored via scale 909. The subject is directed prior to use to adjust the width of the two cradle movement means to fit closely the subject's particular subject width between their hips.

Each cradle movement means thus provides means to move the respective attached cradle in a first plane of movement wherein the cradle is raised or lowered and the hip joint is moved to a position of flexion or extension with a maximum hip flexion of up to 120°. Each control movement means is also operable to rotate about second bearing set 906 thus moving the respective cradle in a second plane of movement transverse to the first plane of movement and generally at right angles (orthogonal) to the first plane of movement. With the subject's leg in a linear position, the non-stretching leg is raised to a bent position and abduction up to 60° and adduction up to 45° can be performed by the user pushing the handle portion 506 to rotate around bearing set 906 either towards the midline of the subject's body or away from the midline of the subject's body. With the stretching leg in an upright bent position similar rotations will result in medial rotation up to 45° and lateral rotation up to 60°. As a result movement in all six anatomical directions about the hip joint can be performed using the apparatus by movement of the handle and the attached cradle through two planes of movement. These ranges of movement are the likely maximum ranges of movement of a human subject, although it is envisaged that the apparatus may extend beyond these ranges of movement.

Each bearing set has an associated locking ratchet allowing the apparatus and subject's leg contained within the cradle to be maintained in a stretched position without the user having to hold the leg or cradle in that position. The flexion ratchet is damped such that upon release of the locking ratchet return to a resting position occurs slowly without damage to the user's muscles or soft tissue or cradle. Means to adjust both height of the cradle movement means and width between the two opposing cradle movement means makes the apparatus suitable for adults of both sexes and subjects of various heights, width and general dimensions.

Figure 10:
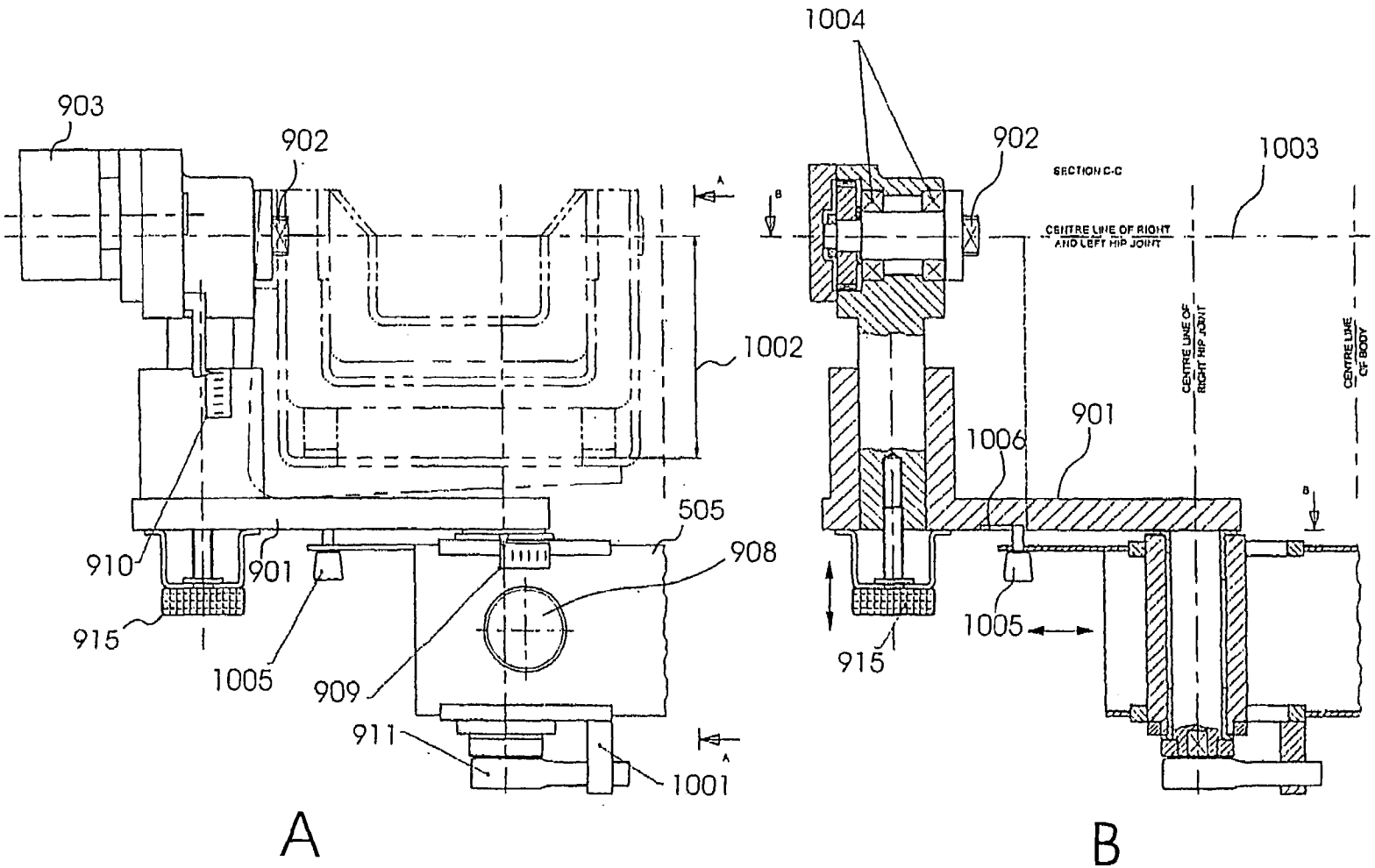
FIG. 10A illustrates a front view of one of the cradle movement means and FIG. 10B illustrates a cross-section C—C (see FIG. 12B) through the same.

FIG. 10A illustrates a side view of one of the cradle movement means from the far end of the first cradle section. The right hand leg cradle sections are shown by dashed lines and a right hand side cradle movement means is illustrated showing the intersection of axle member 902 with the third cradle section. Calibrated scale 910 is provided to monitor vertical adjustment of the cradle movement means. Vertical adjustment is performed by operation of the control knob 915. A second calibrated scale 909 is further provided on frame 505 to monitor width adjustment of the right and left hand side cradle movement mechanisms. The second calibrated scale 909 provides for 18.5 mm horizontal adjustment at each side of the cradle movement means. Rotation through the second plane of movement about the second bearing set operates through ratchet mechanism 911 providing 4° increments and providing a plurality of positions at which the rotation may be locked. A retaining clamp 1001 retains the ratchet in position. Arrow 1002 indicates the preferred distance between the hip joint and buttock of the subject when correctly positioned in the cradle.

Referring to FIG. 10B herein a cross-section through the line C—C (refer to FIG. 12B) is illustrated. Movement of axle member 902 occurs about a first rotational axis extending through the centre line of the right and left hip joints 1003. Angular contact ball bearings 1004 providing radial and axial thrust are provided to form the first bearing set for rotational movement through a first plane of movement in performing flexion and extension stretches. The control knob 915 has a screw thread providing 30 mm vertical adjustment. A spring loaded plunger is moveable between first and second positions in a slotted portion 1006 in the underside of base member 901. To position the right and left hand side cradle movement means at appropriate width to suit a particular subject each spring loaded plunger 1005 is moved downwardly away from the underside of base member 901 and the base member is slid to an appropriate position at which the spring loaded plunger 1005 is re-engaged in the slot 1006. This provides a manual push/pull movement to provide the maximum of 18.5 mm of horizontal adjustment on each side of the apparatus.

Figure 11:
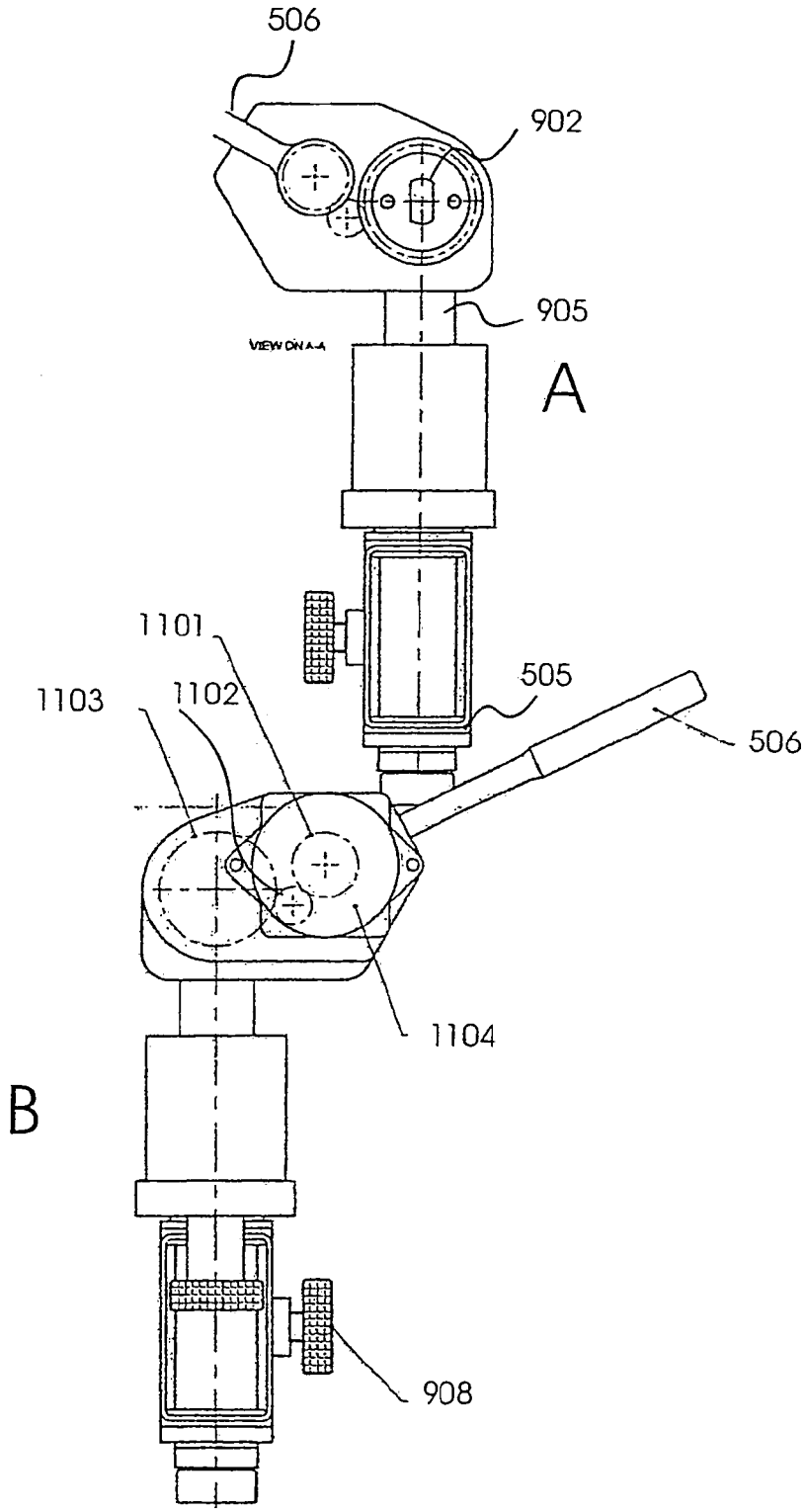
FIG. 11A illustrates a view on the line A—A of FIG. 10A.
FIG. 11B illustrates an opposing side view to FIG. 11A of the cradle movement means.

FIG. 11A illustrates a view of the right hand side cradle means on the line A—A (see FIG. 10A).

FIG. 11B illustrates the right hand side cradle movement means of FIG. 11A illustrating a side view from the exterior of the apparatus. The positioning of the plurality of gears within the cradle movement means for transfer of movement of the handle 506 through a first plane of movement to cause rotational movement of the axle member 902 is illustrated. The first input gear 1101 driven by pushing or pulling of the handle by the subject in a first plane of movement drives a second transfer gear 1102 to rotate a third output gear 1103 connected to the axle member 902. The manually operated gear system is configured to enable the subject to generate sufficient force, by use of the subjects arm strength, to move a leg, overcoming tension in the tissues to perform the stretch. A rotary damper 1104 is further provided to allow controlled descent of the subject's leg and cradle from an elevated position. The handle 506 and gear mechanism further incorporates a ratchet providing for controlled step movement and locking of the respective attached cradle at 4° increments. This provides a coarse control enabling gross movement to position the limb at the current maximum ROM of the subject.

Figure 12:
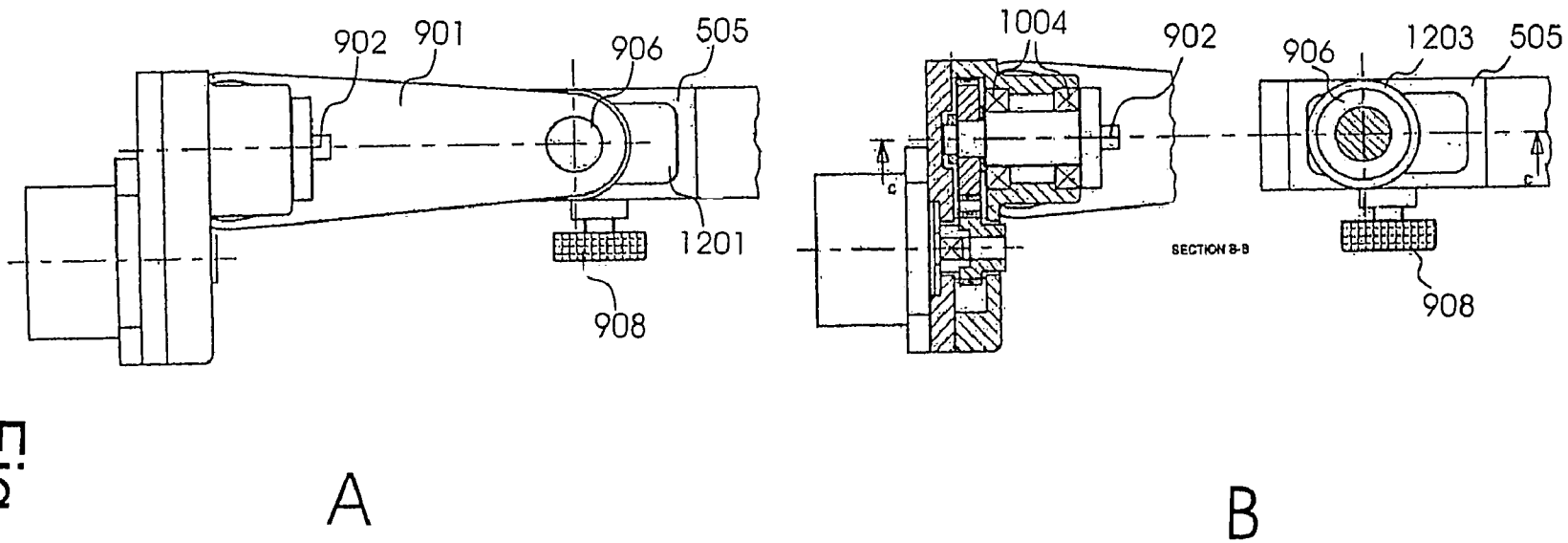
FIG. 12A illustrates a plan view of the right hand limb cradle movement means.
FIG. 12B illustrates a cross-section through the line B—B of FIG. 10B.

FIG. 12A illustrates a plan view of the right hand side cradle movement means illustrating the positioning of the base member 901 on the frame 505. Clamping screw 908 provides for locking and unlocking of the base member 901 in a desired position and the slot 1201 formed in the frame member 505 provides for sliding movement of the second bearing set 906 to adjust the width between the right hand side and left hand side cradle movement means.

FIG. 12B illustrates a cross-section through the line B—B (see FIG. 10B) illustrating the angular contact ball bearings 1004 transferring movement of handle portion in the first plane of movement to axle member 902 to cause lifting and lowering of the connected cradle portion. The locating shaft 1203 of the second bearing set 906 providing location of the second bearing set 906 in the frame 505 is further illustrated.

Figure 13:
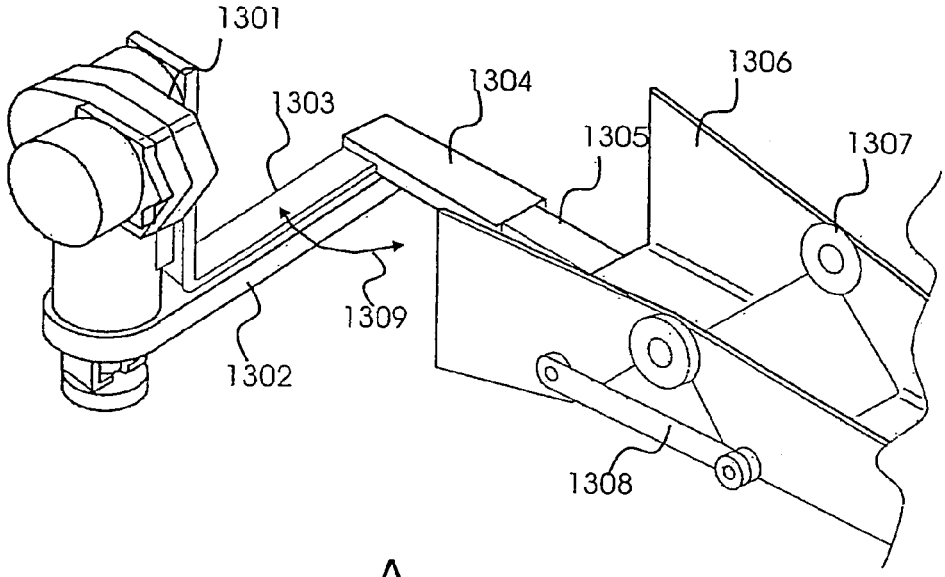
FIG. 13A illustrates the cradle movement means and cradle second section in external perspective view in accordance with a second embodiment of the present invention.
FIG. 13B illustrates a plan view of the cradle movement means and cradle second section in accordance with the second embodiment of the present invention.
Figure 13:
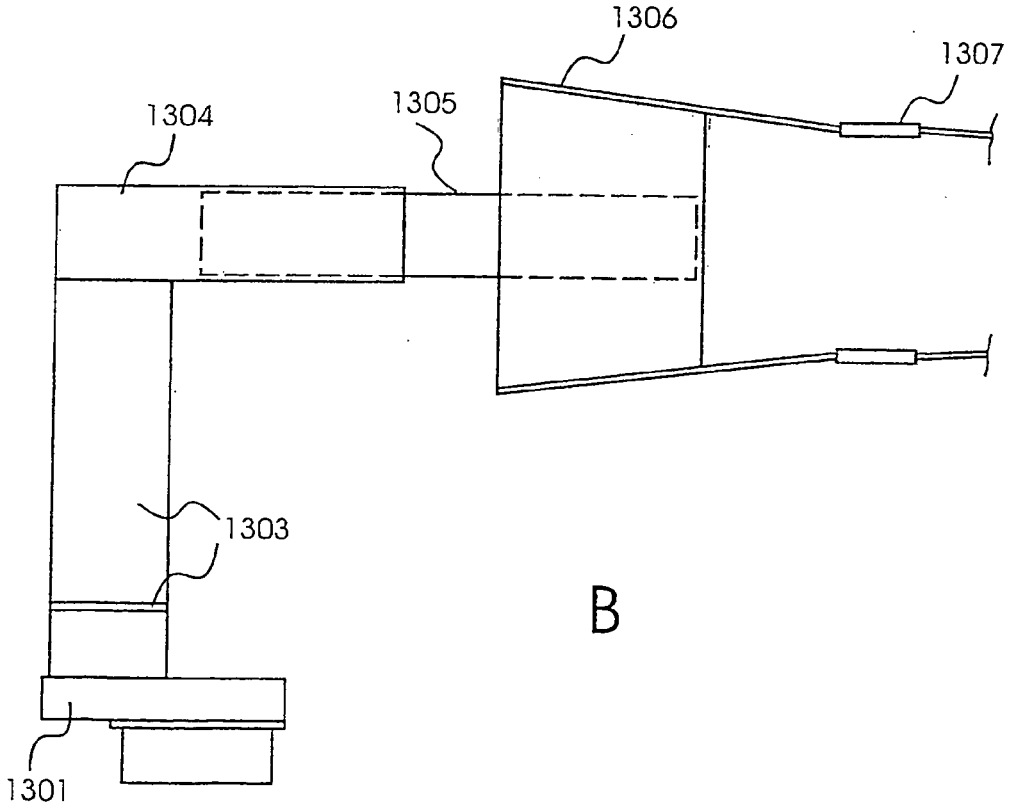

Referring to FIGS. 13A and 13B herein, a second embodiment of the stretching apparatus of the present invention is illustrated. In the second embodiment the cradle's second section 1306 which, in use, supports the subject's upper leg and thigh is indirectly connected to the cradle movement means 1301. Cradle movement means 1301 corresponds to the cradle movement means as described in respect of the first embodiment. The first and second embodiments differ in the mechanism by which each cradle is connected to the respective cradle movement means. In the second embodiment, an L-shaped arm 1303 is positioned over the base member 1302 to connect to a supporting rod member 1304 which is connected to second cradle section 1306 by an adjustable bar member 1305. Second cradle section 1306 is further connected to a first cradle section for supporting the lower leg below the knee by hinge 1307 and latch member 1308.

L-shaped arm 1303 is connected to an axle member of the cradle movement means 1301 to transmit movement of the cradle movement means through a first plane of movement to the cradle to perform extension and flexion stretches. Operation of cradle movement means 1301 through a said first plane of movement swings arm 1303 through an arc indicated by arrow 1309. Arm 1303 is connected to rod member 1304 which transmits movement to cradle second section 1306 through adjustable bar member 1305.

Bar member 1305 is slideably mounted at one end either at the underside of rod member 1304 or within an internal cavity formed by rod member 1304. At a second end, bar member 1305 is securely fixed to the underside of cradle second section 1306. A spring mounted resilient plunger forms a clamp for positioning bar member 1305 in one of a plurality of optional preset positions providing for adjustment of the apparatus to accommodate subjects having different leg lengths. Rod member 1304 is mounted over the second bearing set as described in respect of the first embodiment which is in turn mounted in a frame (not shown) as described in respect of the first embodiment.

A locking means is further provided to retain arm 1303 in a central position over base member 1302 to isolate rotation of the cradle about the second bearing set from rotation about the first bearing set during performance of adduction or abduction stretching. The locking mechanism comprises a spring loaded bolt member mounted on the underside of base member 1302 and arranged to be urged into locking position through corresponding apertures on base member 1302 and arm 1303. This prevents movement of the arm 1303 and attached cradle through the first plane of movement where rotation only about the second bearing set is required to perform the stretch. Use of this locking means allows for isolation of the cradle with respect to a selected plane of movement which enables stretching to be selectively performed through a specific plane of movement, thereby allowing for a stretch of a selected set of muscles.

The second embodiment provides an indirect connection between cradle and cradle movement means which enables the cradle movement means to be positioned outward from the position of the subject's hip relative to the arrangement of the first embodiment. This is advantageous as it prevents possible impingement of cradle movement means on the side of the subject's body during rotation about the second bearing set when leg abduction stretching is being performed. The use of L-shaped arm 1303 and rod and bar members 1304, 1305 also enable a stronger attachment to cradle movement means 1301. In the second embodiment the third cradle section is not required and is replaced by indirect attachment using arm 1303, rod member 1304 and adjustable bar 1305 for connection to cradle movement means 1301.

In a third embodiment of the present invention, the examination table and stretching apparatus are located approximately 15–30 cm from a ground surface. Support means is provided to support at least one cradle in a position of 0° flexion. The support means comprises a support leg, provided on the underside of one or both of the first cradle sections which extends substantially transverse to the main under surface of the first cradle section towards a ground surface, contacting the ground surface and providing a support leg to support the subject's legs within the respective cradles. A roller or castor is provided at one end of the support leg configured to contact the ground surface. The support leg is provided in order to decrease the load on each of the ratchets of the cradle movement means which operate to maintain a selected position of each cradle through the first plane of movement. Each castor is configured to move across a ground surface such that abduction and adduction stretches can be performed wherein each castor rolls across the ground surface as the corresponding cradle and subject's leg are stretched.

Each castor is hingeably mounted at the underside of the respective first cradle section such that when the first cradle section is moved to a raised position, eg during flexion or lateral/medial rotation stretching the support leg hinges towards the underside of the cradle section into a storage position. As the cradle is lowered towards a position of 0° flexion the support leg automatically extends towards the ground surface to contact the ground surface and support the cradle.

In other respects, the third embodiment of the present invention is compatible with features of either or both the first and second embodiments of the present invention.

Figure 14A:
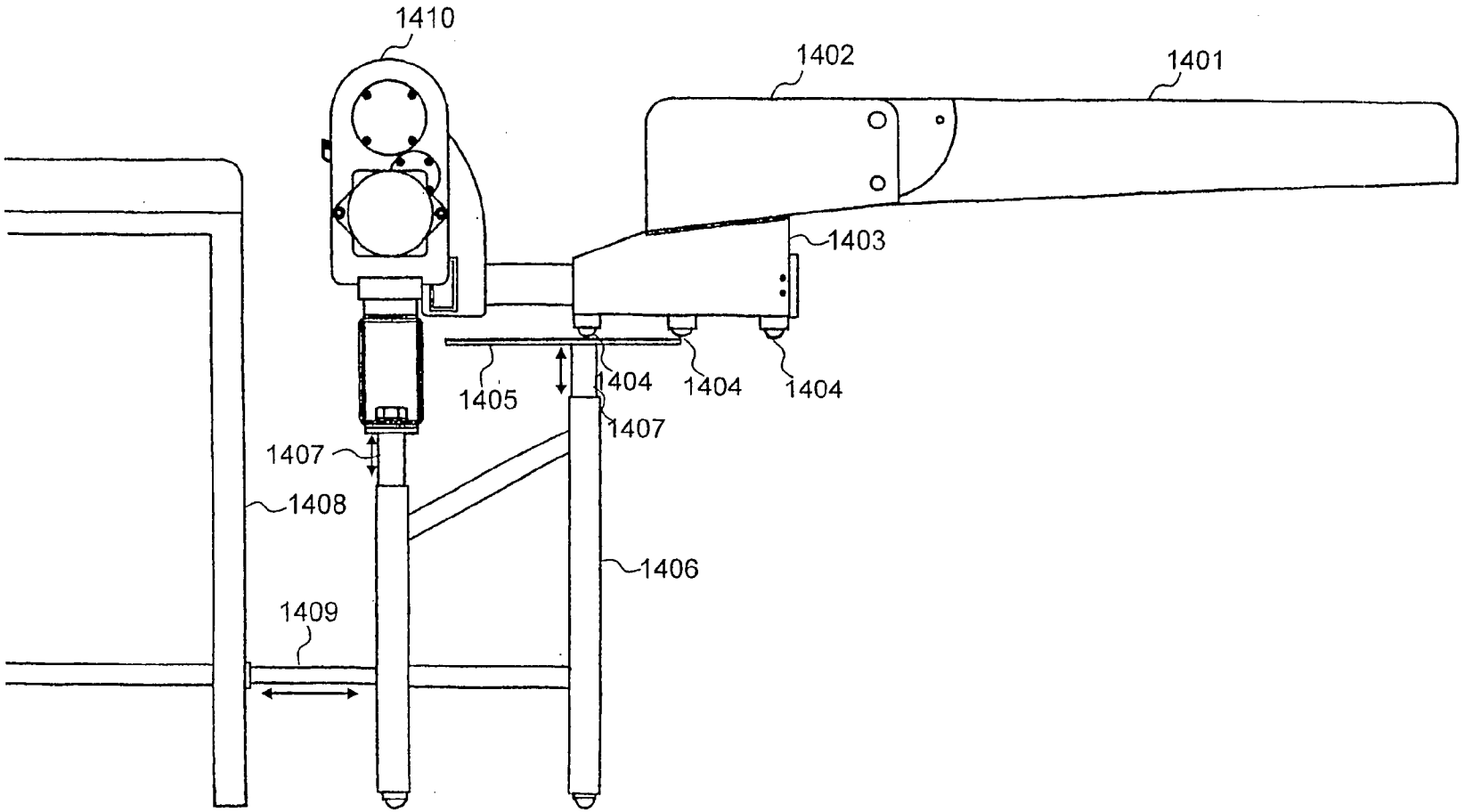
FIG. 14A illustrates an elevation view of the right hand limb cradle and chassis of the stretching apparatus in accordance with a fourth embodiment of the present invention.

In a fourth embodiment of the present invention, the stretching apparatus is located above a support surface. Referring to FIG. 14A herein, there is illustrated an elevation view of the right hand limb cradle and chassis of the stretching apparatus in accordance with the fourth embodiment. The right hand limb cradle comprises a first cradle section 1401, a second cradle section 1402, and an arm 1403 that is connected to the second cradle section 1402. In the fourth embodiment the third cradle section is not required and is replaced by indirect attachment using arm 1403 for connection to the cradle movement means 1410.

The arm 1403 comprises at least one roller, castor or stub 1404 which extends substantially transverse to a main undersurface of the arm 1403 when the limb cradle is in a position of 0° flexion. The rollers, castors or stubs 1404 are in contact with a support surface 1405. This contact decreases the load on each of the ratchets of the cradle movement means 1410 which operates to maintain a selected position of each cradle through the first plain of movement. A height of the support surface 1405, and a height of the cradle movement means 1410, are adjustable relative to the chassis 1406 using adjustment means 1407. Furthermore, a distance of the chassis 1406 in relation to the examination table 1408 is adjustable using second adjustment means 1409. The first and second adjustment means allow for variations in a subject position or variations in a subject's anatomical dimensions.

Figure 14B:
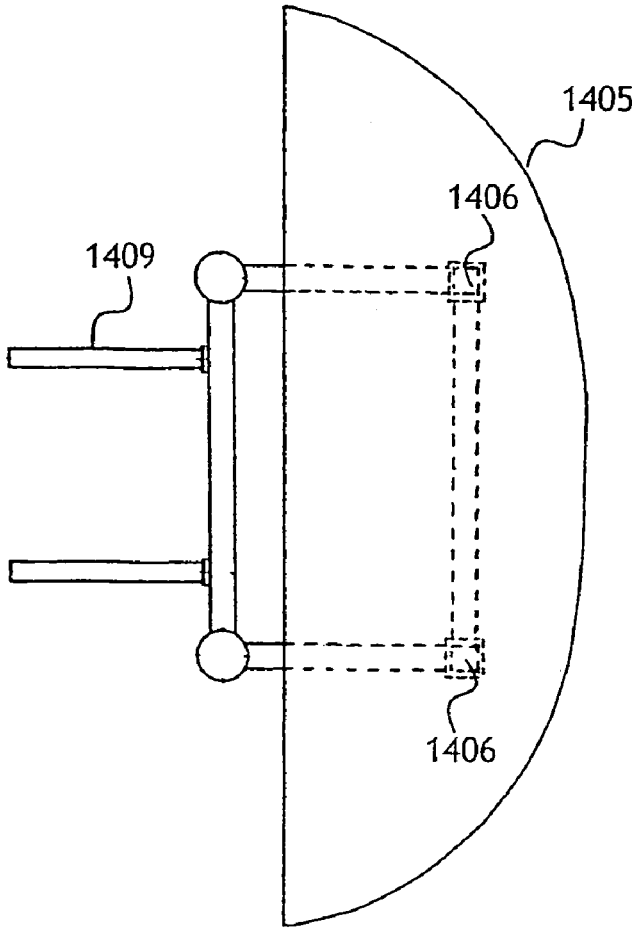
FIG. 14B illustrates a plan view of the support surface in a fourth embodiment of the present invention.

When the limb cradle is in a position of 0° flexion, the rollers, castors, or stubs 1404 are in contact with the support surface 1405. It can be seen from FIG. 14B that the support surface 1405 is shaped to allow contact with the rollers, castors or stubs when abduction and adduction stretches are performed.

In other respects, the fourth embodiment of the present invention is compatible with features of any previous embodiment of the present invention.

Figure 15A:
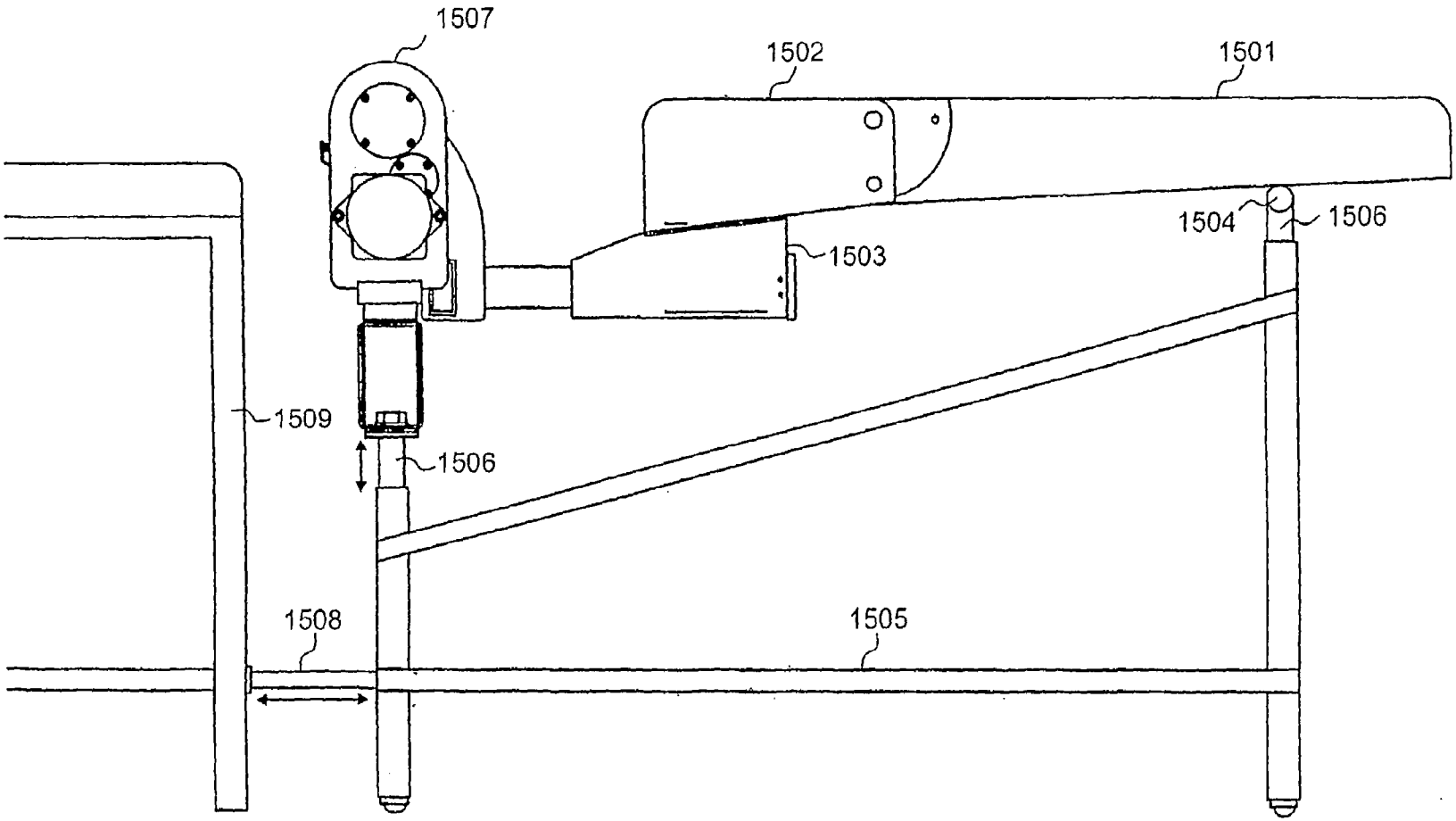
FIG. 15A illustrates an elevation view of the right hand limb cradle and chassis of the stretching apparatus in accordance with a fifth embodiment of the present invention.
Figure 15B:
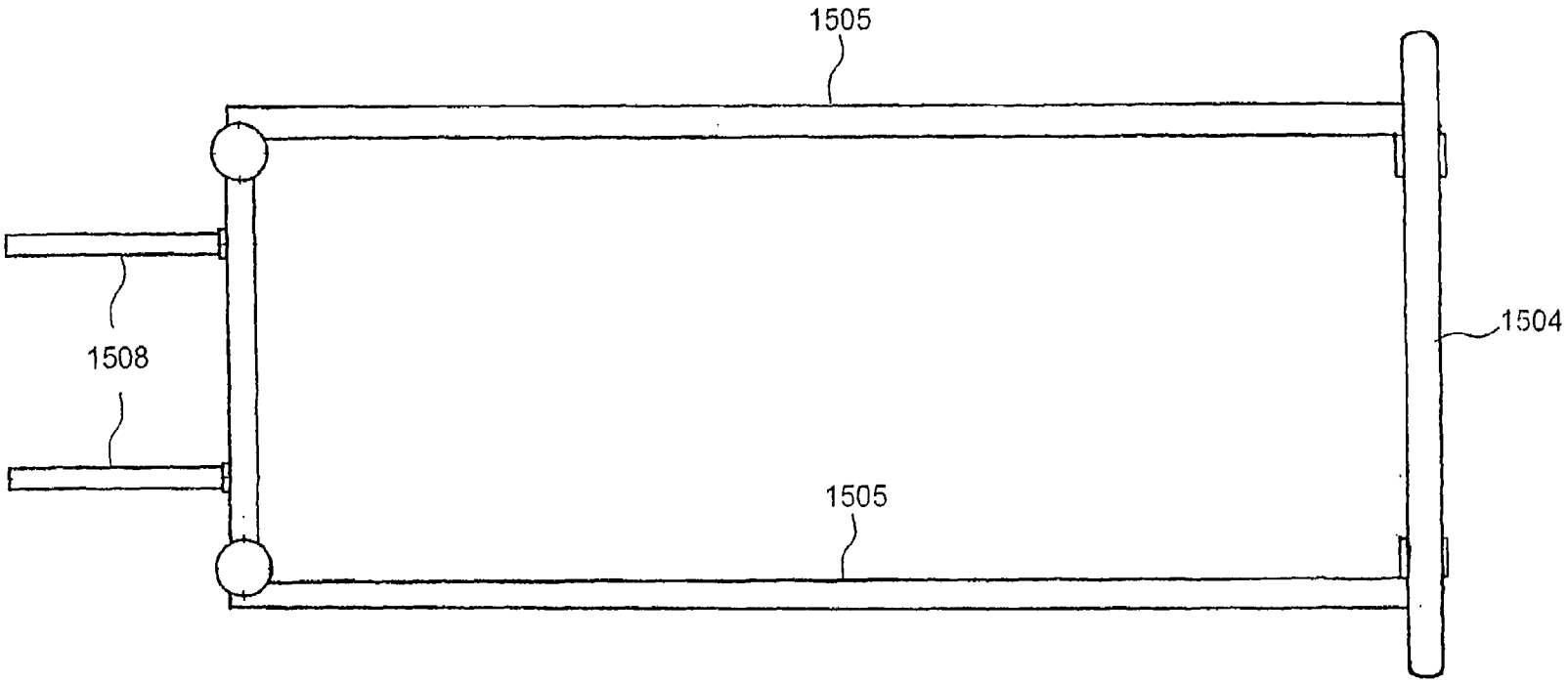
FIG. 15B illustrates a plan view of the support bar in a fifth embodiment of the present invention.

In a fifth specific embodiment, the stretching apparatus is located above a support bar. Referring to FIG. 15A herein, there is illustrated schematically an elevation view of a right hand limb cradle and chassis of the stretching apparatus in accordance with the fifth embodiment. The right hand limb cradle comprises a first cradle section 1501, a second cradle section 1502, and an arm 1503 attached to the second cradle section 1502. In the fifth embodiment the third cradle section is not required and is replaced by attachment using arm 1503 for connection to the cradle movement means 1507.

When the cradle is in a position of 0° flexion, the first cradle section 1501 is in contact at its lower surface with a support bar 1504. The support bar 1504 and the cradle movement means 1507 are located on a chassis 1505. A height of the support bar and a height of the cradle movement means are adjustable relative to the chassis using height adjustment means 1506. Furthermore, a distance of the chassis in relation to the examination table 1509 is adjustable using horizontal adjustment means 1508. The vertical and horizontal adjustment means may be used to compensate for variations in a subject's anatomical dimensions.

When performing abduction or adduction stretches, the cradle remains in a position of 0° flexion and therefore remains in contact with the support bar 1504 for at least an initial stage of the abduction or adduction stretch. To facilitate movement between the first cradle section 1501 and the support bar 1504, the support bar 1504 may comprise a low friction material, for example PTFE.

In other respects, the fifth embodiment is compatible with features of any of the previous embodiments of the present invention.

Figure 16A:
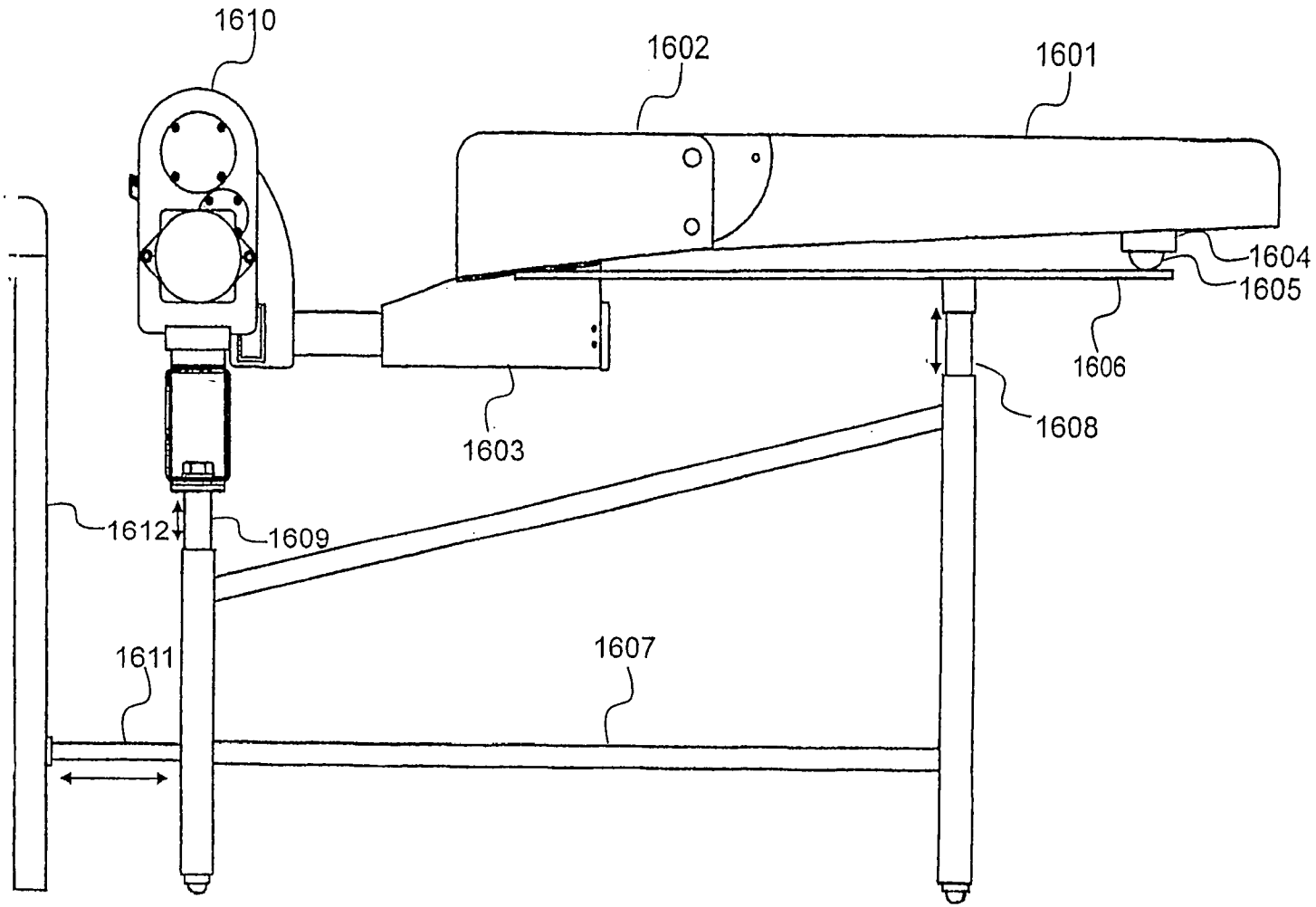
FIG. 16A illustrates an elevation view of the right hand limb cradle and chassis of the stretching apparatus in accordance with a sixth embodiment of the present invention.

In a sixth embodiment, the first cradle section of the stretching apparatus is located above a support surface. Referring to FIG. 16A herein, there is illustrated an elevation view of the right hand limb cradle and chassis of the stretching apparatus in accordance with the sixth embodiment. The right hand limb cradle comprises a first cradle section 1601, a second cradle section 1602 and an arm 1603 forming indirect attachment between the second cradle section 1602 and the cradle movement means 1610. In the sixth embodiment the third cradle section is not required and is replaced by indirect attachment using arm 1603 for connection to cradle movement means 1610.

Figure 16B:
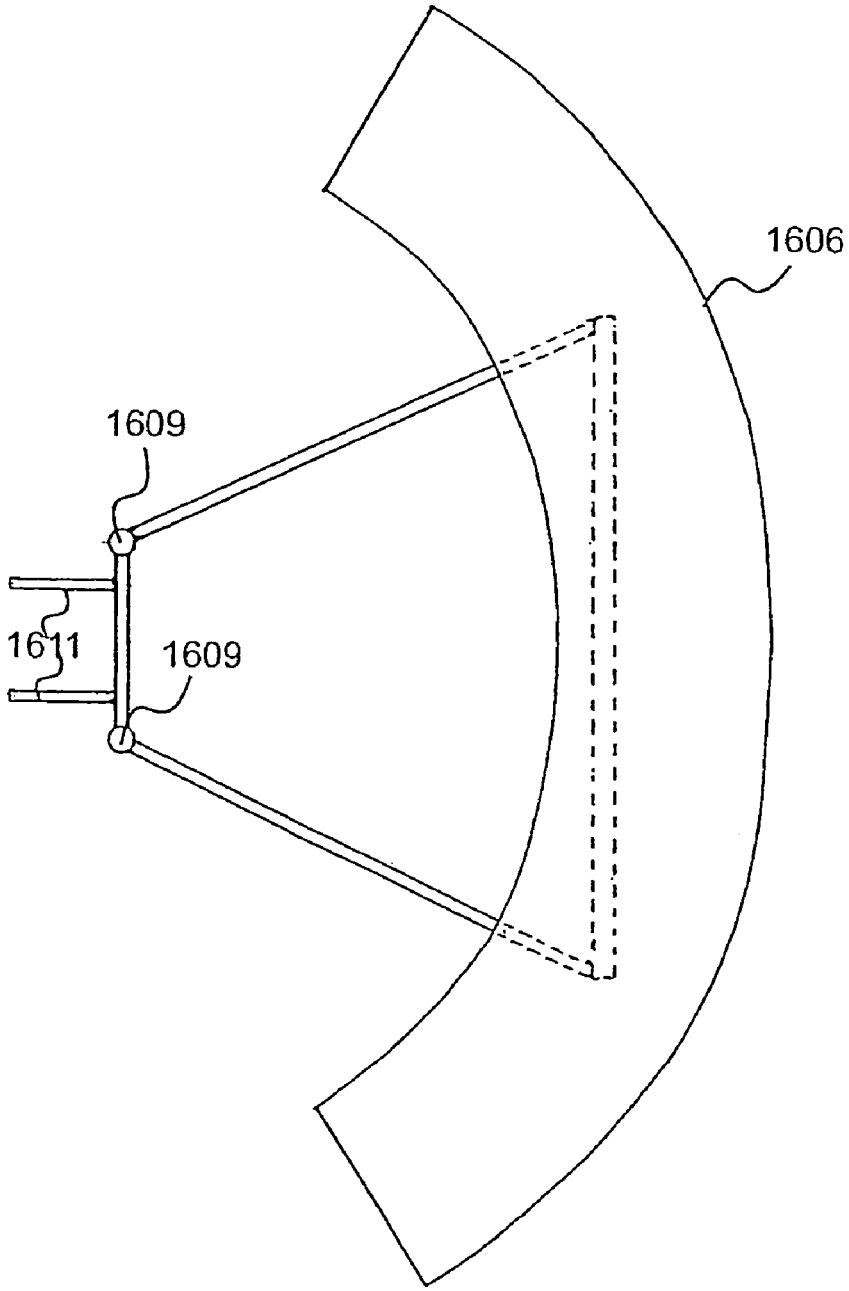
FIG. 16B illustrates a plan view of the support surface of the sixth specific embodiment of the present invention.

A support arm 1604 comprising a stub or a castor 1605 is located on a lower surface of the first cradle section 1601. The stub or castor 1605 is in contact with a support surface 1606 when the right hand limb cradle is in a position of 0° flexion. A height of the support surface 1606 is adjustable relative to the chassis 1607 using adjustment means 1608. In addition, a height of the cradle movement means 1610 is adjustable relative to the chassis 1607 using a second height adjustment means 1609. A distance of the chassis 1607 relative to the examination table 1612 is adjustable using horizontal adjustment means 1611. These adjustments allow for variations in a subject's anatomical dimensions. Referring to FIG. 16B herein, it is shown that the support surface 1606 is shaped to allow contact between the support surface 1606 and the castor or stub 1605 when either cradle is used for abduction or adduction stretches.

In other respects, the sixth embodiment of the present invention is compatible with features of any of the previous embodiments.

To provide additional stabilization during use, each cradle can be locked in the central position, i.e. at 0° flexion/extension, 0° adduction/abduction, by use of an optional additional locking means acting on each bearing set whilst the other cradle is operated to stretch the subject's leg. The lock can be selectively activated to prevent movement about the first or second bearing set, both or neither Further optional features of the stretching apparatus include a means for measuring the displacement of each cradle from the recognisable central (neutral) position. An electrogoniometer can therefore be provided for analysis of the degree of stretch. Measuring the angle of stretch allows for quantitative orthopaedic assessment and monitoring of recovery from injury over time.

In further alternative arrangements the first cradle section supporting the lower half of the subject's leg, ie the calf and foot, is also adjustable in length and contains a foot-shaped support to support and limit movement of all or part of the respective foot.

In a further alternative arrangement, the examination table has a first end that is in close proximity to the stretching apparatus, and a second end in opposition to the first end. Cradle movement means are positioned at the first end of the examination table. A width of the first end is smaller than a width of the second end to allow room for the full movement of the handle of the cradle movement means.

The stretching device of the present invention may be made in separate male, female and children's versions by variation of the apparatus dimensions.

A mode of operation of the apparatus of the present invention, according to any of the embodiments described, for performing a variety of leg stretches will now be described. The stretching apparatus in accordance with FIG. 5 is initially located at an examination table. The examination table optionally comprises a pelvic clamp 304. The subject is positioned on the table in supine position, the subject's legs are placed in respective left hand and right hand limb cradles and the pelvic clamp and belt are placed in position to isolate movement of the lower limbs from the upper body. The subject's arms remain free during use of the apparatus and in a position so as to grasp the handle portions 506 to operate the apparatus to perform various stretches. Once the subject has placed each leg in the respective cradle a strap is fastened over the upper and lower half of each leg extending from one wall portion of the respective cradle to the opposing wall portion and thereby encompassing the leg within the cradle. The subject can perform a stretching program as desired and may choose to stretch one or both legs at any one time. The following is an example stretching program in which all stretches begin from a resting position as illustrated in FIG. 1A, only one limb is stretched at a time:

Stretch 1—Flexion

To perform flexion stretch of the left leg the subject pulls handle 506 of the left hand side cradle movement means towards the subject through an arc parallel to the wall portion of the third cradle portion 503. Flexion can occur for up to 120° from the resting normal position and the subject performs the flexion to an extent at which stretch is occurring and the subject is comfortable. The subject may then release the handle 506 wherein the stretch is maintained via the ratchet mechanism which allows the subject to fine control the stretch allowing small movements so as to bring the limb under stretch to a new position of tension by effectively taking up the slack in the leg as stretch occurs. For example, the subject can operate the handle 506 to move one step through the ratchet to achieve a further 4° rotation and further stretch. Again, the leg can be maintained by the locking ratchet in the new stretch position. This position can then be maintained by the subject for a pre-determined time length defined in the stretching schedule being implemented. When the subject decides to relax the leg, the ratchet is released through use of a catch or other control means at the handle or cradle movement means main body and the respective cradle is lowered from the flexion position to return to a resting position. This lowering movement occurs slowly via the damping mechanism within the control movement means.

Stretch 2—Extension

Extension stretching is generally illustrated in FIG. 2. To achieve an optimal stretching position the non-stretching leg is placed in a raised and bent position as illustrated in FIG. 2. To move the non-stretching leg to the resting position the subject pulls the respective handle portion 506 through the first plane of movement to achieve an approximately 120° stretch as for flexion. The first cradle section 501 is rotated about hinge 507 such that the subject's knee bends such that the thigh and calf of the resting leg are at approximately 90°. This position is then maintained by the locking ratchet of the respective control movement means and supported by the respective leg cradle.

For a subject who exhibits tightness in the hip flexor muscles the thigh of the stretching leg will rise upwards to a position illustrated in FIG. 2. The stretching leg, which is retained in the cradle by means of straps, can be positioned in either two ways. One is achieved by rotating the first cradle section of the limb cradle housing the stretching leg about hinge 507 downwardly such that the first and second cradle portions 501 and 502 are positioned to house the thigh and calf of the stretching leg at approximately 90°. The other is to maintain the stretching leg in extended linear position as illustrated by the dashed lines in FIG. 2. The ratchet mechanism for maintaining the flexion position is then released, allowing the weight of the cradle and stretching leg to provide a downwards force to stretch the muscles on the front of the thigh. Additionally, the direction of the ratchet mechanism can be reversed such that by pushing on the handle 506 the subject can exert a downwards force on the cradle to augment the downwards force resulting from the weight of the cradle and stretching leg.

Stretch 3—Medial and Lateral Rotation

The resting leg is maintained supported by a cradle in extended linear position. The stretching leg is raised through a first plane of movement using handle portion 506 and the second and third limb cradle sections are adjusted to be positioned at right angles so as to support the thigh and calf of the stretching leg at approximately 90° in raised position as illustrated in FIG. 1C. This raised position can be maintained by use of the locking ratchet of the respective cradle movement means. The subject is then in position to perform both medial and lateral rotation stretches about the hip joint. Medial rotation stretching is performed by the subject pushing on handle portion 506 to move the handle portion and cradle through a second plane of movement about second bearing set 906. To perform medial rotation stretching of the left leg this rotation will occur in a counter-clockwise direction about second bearing set 906. To perform lateral rotation stretching the subject operates handle portion 506 throughout the second plane of movement in a direction so as to move the stretching leg across the midline of the subject's body. For lateral rotation stretching of the left leg rotation occurs in a clockwise direction about bearing set 906. For both types of stretching the ratchet mechanism on the second bearing set 906 allows the stretch to be maintained in position until the subject desires to release the stretch.

Stretch 4—Adduction and Abduction

In the resting position the subject operates handle portion 506 to rotate about second bearing set 906 to move a stretching leg either away from the body (abduction) or across the midline of the body (adduction) whilst maintaining the leg in the coronal plane, i.e. substantially within the main plane of the subject's body. For abduction stretching of the left leg rotation of the cradle about second bearing set 906 occurs in counter clockwise direction. For performance of adduction stretching the resting leg is moved to a raised and bent position as described in respect of positioning the leg for medial and lateral rotation stretching such that the stretching leg can be moved across the midline of the subject's body without the resting leg interfering with the stretch. The resting leg is supported in the raised and bent position by a respective cradle. For adduction stretching of the left leg rotation of the cradle occurs about second bearing set 906 in a clockwise direction. For both types of stretching the ratchet mechanism on the second bearing set 906 allows the stretch to be maintained in position until the subject desire to release the stretch.

The above descriptions of stretches are by way of example only, and are not intended to limit the ways in which the present invention may be practiced. For example, to perform the above stretches the subject need not be in the supine position, but may be in the anatomical position or in a position with the hips at substantially 90° flexion.

Where the subject is in the anatomical position, flexion stretches may be performed by operating the cradle movement means to move the cradle substantially in the sagittal plane.

Where the subject is in the anatomical position, abduction and adduction stretches may be performed by operating the cradle movement means to cause rotation of the cradle substantially in the coronal plane with respect to the subject.

Where the subject's hips are at substantially 90° flexion, abduction stretches may be performed by operating the cradle movement means to cause rotation of the cradle substantially in the transverse plane with respect to the subject.

The invention claimed is:

1. Stretching apparatus for use in stretching the lower limbs of a human subject said apparatus comprising:

first and second cradles each independently movable and each configured to support a leg, or part thereof, of said subject, each said cradle being movable between a corresponding respective non-stretching position and a corresponding respective stretching position; and first means for moving a cradle, said first means operable to independently move said first cradle between said non stretching and stretching positions, said first means for moving a cradle comprising:

rotation means configured to rotate said first cradle in a first plane of movement;

rotation means configured to rotate said first cradle, in a second plane of movement transverse to a said first plane of movement;

second means for moving a cradle, said second means operable to independently move said second cradle between said non stretching and stretching positions, said second means for moving a cradle comprising:

rotation means configured to rotate said second cradle in a third plane of movement; and rotation means configured to rotate said second cradle in a fourth plane of movement transverse to said third plane of movement.

2. Stretching apparatus as claimed in claim 1, wherein each said cradle comprises respective first and second ends, a said first end of each said cradle being attached to a respective said means for moving a cradle, and each said cradle extending between its said first end, to which said cradle is attached, and its second end.

3. Stretching apparatus as claimed in claim 1, wherein a said cradle comprises a first portion configured to support a portion of the subject's leg below the subject's knee, a second portion configured to support the subject's leg above the knee, and a hinge connecting said first and second portions.

4. Stretching apparatus as claimed in claim 1, wherein a said cradle comprises a first portion configured to support a portion of the subject's leg below the subject's knee, a second portion configured to support the subject's leg above the knee, and a hinge connecting said first and second portions, and said first and second portions are movable about said hinge to position the subject's leg in either a straight or a bent position.

5. Stretching apparatus as claimed in claim 1, wherein a said cradle further comprises means to adjust the cradle length.

6. Stretching apparatus as claimed in claim 1, wherein a said cradle further comprises means to adjust the cradle length, said means to adjust the cradle length comprising a guide slot having a plurality of notches forming a plurality of adjustment positions; and a portion of said cradle comprises positioning means configured to locate in said notches, wherein said cradle length is slideably adjustable by movement of said positioning means between said notches.

7. Stretching apparatus as claimed in claims 1, wherein a said cradle forms a channel configured to receive the subject's leg.

8. Stretching apparatus as claimed in claim 1, wherein a said cradle forms a channel configured to receive the subject's leg, and further comprising at least one fastening strap arranged to fasten across said channel and said subject's leg contained therein.

9. Stretching apparatus as claimed in claim 1, wherein a said cradle comprises a first portion configured to support a portion of the subject's leg below the subject's knee, a second portion configured to support the subject's leg above the knee, and a hinge connecting said first and second portions, and further comprising a locking means extending between said first and second cradle portions, said locking means arranged to releasably lock said cradle in a selected configuration.

10. Stretching apparatus as claimed in claim 1, wherein a said cradle comprises a first portion configured to support a portion of the subject's leg below the subject's knee, a second portion configured to support the subject's leg above the knee, and a hinge connecting said first and second portions, and further comprising a latch member extending between said first and second cradle portions, said latch member arranged to releasably lock said cradle in a selected configuration.

11. Stretching apparatus as claimed in claim 1, wherein a said cradle comprises a first portion configured to support a portion of the subject's leg below the subject's knee, a second portion configured to support the subject's leg above the knee, and a hinge connecting said first and second portions, and further comprising a spring loaded plunger extending between said first and second cradle portions, said spring loaded plunger arranged to releasably lock said cradle in a selected configuration.

12. Stretching apparatus as claimed in claim 1, wherein said rotation means configured to rotate said first cradle in said first plane comprises a first bearing and axle member connected to one end of a said first cradle, rotation of said axle member about said first bearing being operable for raising or lowering of said first cradle.

13. Stretching apparatus as claimed in claim 1, wherein said rotation means configured to rotate said first cradle in said second plane comprises a second bearing arranged such that rotation of said second bearing operates rotation of a said first cradle in a plane of constant height.

14. Stretching apparatus as claimed in claim 1, wherein:

said rotation means configured to rotate said first cradle in said first plane comprises a first bearing and axle member connected to one end of a said first cradle, rotation of said axle member about said first bearing being operable for raising or lowering of said first cradle;

said rotation means configured to rotate said first cradle in said second plane comprises a second bearing arranged such that rotation of said second bearing operates rotation of a said first cradle in a plane of constant height; and wherein said first and second bearings rotate in said first and second planes of movement, each said plane of movement being offset to the other by 90°.

15. Stretching apparatus as claimed in claim 1, wherein said rotation means configured to rotate said second cradle in said third plane comprises a third bearing and axle member connected to one end of said second cradle, rotation of said axle member about said third bearing being operable for raising or lowering of said second cradle.

16. Stretching apparatus as claimed in claim 1, wherein said rotation means configured to rotate said second cradle in a fourth plane comprises a fourth bearing arranged such that rotation of said fourth bearing operates rotation of a said second cradle in a plane of constant height.

17. Stretching apparatus as claimed in claim 1, wherein:

said rotation means configured to rotate said second cradle in said third plane comprises a third bearing and axle member connected to one end of a said second cradle, rotation of said axle member about said third bearing being operable for raising or lowering of said second cradle;

said rotation means configured to rotate said second cradle in said second plane comprises a fourth bearing arranaed such that rotation of said fourth bearing operates rotation of said second cradle in a plane of constant height; and wherein said third and fourth bearings rotate in said third and fourth planes of movement, each said plane of movement being offset to the other by 90°.

18. Stretching apparatus as claimed in claim 1, wherein a said means for moving a cradle comprises at least one ratchet operable to maintain a said means and a connected said cradle in a selected position.

19. Stretching apparatus as claimed in claim 1, wherein a said means for moving a cradle comprises at least one ratchet operable to maintain a said means and a connected said cradle in a selected position, wherein said ratchet provides a fine control mechanism for controlling a position of said cradle during stretching.

20. Stretching apparatus as claimed in claim 1, wherein a said means for moving a cradle further comprises a damping mechanism configured to dampen return movement of a said cradle from a said stretching position to a said non-stretching position.

21. Stretching apparatus as claimed in claim 1, wherein a said means for moving a cradle further comprises a locking means arranged to maintain an attached said cradle in a first selected position, said looking means releasable to enable movement of said cradle to a second selected position.

22. Stretching apparatus as claimed in claim 1, wherein a said means for moving a cradle further comprises means to measure the movement of a said cradle in a said plane of movement.

23. Stretching apparatus as claimed in claim 1, wherein a said means for moving a cradle comprises a handle portion operable for movement of a said cradle in a said plurality of planes of movement.

24. Stretching apparatus as claimed in claim 1, wherein a said means for moving a cradle further comprises a height adjustment mechanism.

25. Stretching apparatus as claimed in claim 1, wherein a said means for moving a cradle further comprises a height adjustment mechanism which is adiustable to align an axis extending through the subject's hip joints with an axis of rotation of a said rotation means.

26. Stretchjng apparatus as claimed in claim 1, wherein a said apparatus comprises a frame portion which extends between sajd first means for moving a cradle and said second means for moving a cradle.

27. Stretching apparatus as claimed in claim 1, wherein a frame portion extends between said first means for moving a cradle and said second means for moving a cradle, wherein each said means for moving a cradle is slideably mounted on said frame portion, said frame portion further comprising adiustment means arranged to adiust the mounting position of each said means for moving a cradle and thereby to adiust the width between said first and second means for moving a cradle.

28. Stretching apparatus as claimed in claim 1, wherein each said cradle comprises a support leg hingeably mounted at one end of said leg at the underside of a portion of said cradle and a castor attached at a second end of the leg such that said castor is in contact with a ground surface when said cradle is in a position of 0° flexion, said support means comprising a support bar, said support bar configured to be in contact with a lower surface of said cradle when said cradle is in said position of 0° flexion.

29. Stretching apparatus as claimed in claim 1, wherein a support means is provided to support at least one said cradle in a position of 0° flexion.

30. Stretching apparatus as claimed in claim 1, wherein a support means is provided to support at least one said cradle in a position of 0° flexion;

said support means comprising:

an arm configured to connect said cradle to a said means for moving a cradle;

at least one selected from the set of a roller, castor or stub, extending substantially transverse to a main underside of said arm; and a support surface;

wherein when said cradle is in a position of 0° flexion, said one selected from a roller, castor or stub is in contact with said support surface.

31. Stretching apparatus as claimed in claim 1, wherein support means is provided to support at least one said cradle, said support means comprising a support bar, said support bar configured to be in contact with a lower surface of said cradle when said cradle is in said position of 0° flexion.

32. Stretching apparatus as claimed in claim 1, wherein a said cradle comprises at least one roller mounted at the underside of a portion of said cradle such that said roller is in contact with a support surface when said cradle is in a position of 0° flexion.

33. Stretching apparatus as claimed in claim 1, wherein a said cradle comprises at least one castor mounted at the underside of a portion of said cradle such that said castor is in contact with a support surface when said cradle is in a position of 0° flexion.

34. Stretching apparatus as claimed in claim 1, further comprising a table arranged to support the upper body of said subject and connected to said apparatus at one end to support a subject in a supine position.

35. Stretching apparatus as claimed in claim 1, further comprising a table arranged to support the upper body of said subject and connected to said apparatus at one end to support a subject in a supine position, wherein a distance between said table and said apparatus is adiustable in a horizontal plane.

36. Stretching apparatus as claimed in claim 1, further comprising a table arranaed to support the upper body of said subject and connected to said apparatus at one end to support a subject in a supine position, wherein a distance between said table and said apparatus is adjustable in a vertical plane.

37. Stretching apparatus as claimed in claim 1, further comprising a table arranged to support the upper body of said subject and connected to said apparatus at one end to support a subject in a supine position wherein said apparatus further comprises a pelvic clamp comprising at least one clamping member movable to engage at the pelvis of a subject positioned in supine position on said apparatus, said clamp adjustable to tighten around the subject's pelvis.

38. Stretching apparatus as claimed jn claim 1, further comprising a table arranged to support the upper body of said subject and connected to said apparatus at one end to support a subject in a supine position wherein said apparatus further comprises a pelvic clamp comprising at least one clamping member movable to engage at the pelvis of a subject positioned in supine position on said apparatus, said clamp adjustable to tighten around the subject's pelvis, and said clamping member is shaped to surround the pelvic iliac crests of a said human subject.

39. Stretching apparatus as claimed in claim 1, for use in performing one or more stretches of muscle and soft tissue surrounding the human hip joint, said one or more stretches selected from the set comprising:

extension stretching; and/or flexion stretching; and/or medial rotation stretching; and/or lateral rotation stretching; and/or adduction stretching; and/or abduction stretching.

40. Stretching apparatus as claimed in claim 1, comprising:

a support table configured to support said subject's back and upper body in a supine position;

at least one said means for moving a cradle being operable by said subject from said supine position to move said cradles between a said non-stretching position and a said stretching position.

41. Stretching apparatus as claimed in claim 1, comprising:

a support table configured to support said subject's back and upper body in a supine position;

a said means for moving a cradle being operable by said subject from said supine position to move a said cradles between a non-stretching position and a stretching position, and wherein each said cradle is independently movable by a separate said means for moving a cradle.

42. Stretching apparatus as claimed in claim 1, comprising:

a support table configured to support said subject's back and upper body in a supine position;

a said means for moving a cradle being operable by said subject from said supine position to move a said cradles between a non-stretching position and a stretching position; and wherein each said means for moving a cradle is located in the region of one end of a respective said cradle so as to locate each said means for moving a cradle, in use adjacent said subject's respective hip joints.

43. Stretching apparatus as claimed in claim 1, comprising:

a support table configured to support said subject's back and upper body in a supine position;

a said means for moving a cradle being operable by said subject from said supine position to move a said cradle between a non-stretching position and a stretching position, and further comprising a clamp arranged to engage at the pelvis of a subject positioned on said apparatus in said supine position.

44. Stretching apparatus as claimed in claim 1, comprising:

a support table configured to support said subject's back and upper body in a supine position;

a said means for moving a cradle being operable by said subject from said supine position to move said cradles between a non-stretching position and a stretching position, and further comprising:

a clamp arranged to engage at the pelvis of a subject positioned on said apparatus in said supine position;

wherein said clamp comprises first and second clamping members arranged on opposite long sides of said table and means to urge said members together.

45. Stretching apparatus as claimed in claim 1 wherein said means for moving a cradle is supported in use by a support surface.

46. Stretching apparatus for use in performing controlled stretching of the muscles and soft tissues associated with the human hip joint said apparatus comprising:

first and second cradles each independently movable for use in positioning a subject's legs during stretching and each configured to support a leg, or part thereof, of said subject, each said cradle being movable between a corresponding respective non-stretching position and a corresponding respective stretching position; and two means for moving a cradle, each said means connected to a corresponding respective said cradle, means for moving a cradle having first and second pivots forming first and second axes of rotation, said each said means for moving a cradle operable independently to move said respective connected cradle in a sagittal plane with respect to a human subject, and to move said respective connected cradle in a coronal plane with respect to a human subject.

47. Stretching apparatus for use in performing abduction and/or adduction stretching of a human subject's thigh adductor and/or abductor muscles respectively, said apparatus comprising:

first and second cradles each independently movable and each configured to support a leg, or part thereof, of said subject, each said cradle being movable between a corresponding respective non-stretching position and a corresponding respective stretching position, such that said leg is held substantially in an extended position; and first and second means for moving a cradle, each said means operable to independently move a corresponding respective said cradle between said non-stretching and stretching positions, each said means for moving a cradle comprising:

rotation means configured to rotate said corresponding cradle in a corresponding respective first plane of movement; and rotation means configured to rotate said corresponding cradle in a corresponding respective second plane of movement transverse to a said first plane of movement, wherein:

at least one said means for moving a cradle, said means being operable to rotate a said cradle about an axis of rotation and in a said plane of movement so as to move said leg across and/or away from a midline of said subject's body to perform adduction and/or abduction stretches of the subject's leg respectively.

48. Stretching apparatus as claimed in claim 44, wherein when said human subject is substantially in the anatomical position, said means for moving a cradle is capable of moving said cradle in substantially the coronal plane with respect to said human subject.

49. Stretching apparatus as claimed in claim 44, wherein when said human subject's hips are substantially in a position of 90° flexion, a said plane of movement is substantially the transverse plane with respect to said human subject.

50. Stretching apparatus for use in performing medial or lateral rotation stretching of a human subject's thigh lateral rotator or medial rotator muscles respectively, said apparatus comprising:

first and second cradles each independently movable and each configured to support a leg, or part thereof, of said subject, each said cradle being movable between a corresponding respective non-stretching position and a corresponding respective stretching position; and at least one means for moving a said cradle, said means operable to independently move a said cradle between a said non-stretching and stretching positions, said at least one means for moving a cradle comprising:

rotation means configured to rotate said cradle in a first plane of movement; and rotation means configured to rotate said cradle in a second plane of movement transverse to a said first plane of movement, wherein:

at least one said cradle is configured to support a leg, or part thereof, in a position such that the thigh of the supported leg is substantially orthogonal to the subject's upper body, said cradle being rotatable about an axis of rotation so as to move a portion of said supported leg in a direction across or away from a midline of the subject's body to perform lateral rotation or medial rotation stretches respectively; and said at least one means for moving a cradle being operable to rotate said cradle about said axis of rotation, wherein in use, said axis is arranged to be substantially coincident with an axis extending through a subject's respective hip joint and knee joint.

* * * * *

UNITED STATES PATENT AND TRADEMARK OFFICE

CERTIFICATE OF CORRECTION

PATENT NO. : 7,153,251 B2
APPLICATION NO. : 10/518319
DATED : December 26, 2006
INVENTOR(S) : Hugo Broadbent It is certified that error appears in the above-identified patent and that said Letters Patent is hereby corrected as shown below:

Col. 19, line 56, claim 17, “arranaed” should be --arranged--
Col. 20, line 13, claim 21, “looking” should be --locking--
Col. 20, line 32, claim 26, “stretchjng” should be --stretching--
Col. 20, line 34, claim 26, “sajd” should be --said--
Col. 20, line 41, claim 27, “adiust” should be --adjust--
Col. 20, line 42, claim 27, “adiust” should be --adjust--
Col. 21, line 30, claim 36, “arranaed” should be --arranged--
Col. 21, line 43, claim 38, “jn” should be --in--

Signed and Sealed this

Eighth Day of July, 2008

JON W. DUDAS
*Director of the United States Patent and Trademark Office*